US010205209B2

(12) United States Patent
Zhu et al.

(10) Patent No.: US 10,205,209 B2
(45) Date of Patent: Feb. 12, 2019

(54) MULTI-BAND BANDPASS FILTER

(71) Applicant: COM DEV Ltd., Mississauga (CA)

(72) Inventors: Li Zhu, Cambridge (CA); Ming Yu, Waterloo (CA); Raafat R. Mansour, Waterloo (CA)

(73) Assignee: COM DEV LTD., Mississauga (CA)

( * ) Notice: Subject to any disclaimer, the term of this patent is extended or adjusted under 35 U.S.C. 154(b) by 110 days.

(21) Appl. No.: 15/343,280

(22) Filed: Nov. 4, 2016

(65) Prior Publication Data

US 2018/0131063 A1 May 10, 2018

(51) Int. Cl.
*H01P 1/208* (2006.01)
*H01P 7/10* (2006.01)

(52) U.S. Cl.
CPC ..... *H01P 1/2082* (2013.01); *H01P 1/2086* (2013.01); *H01P 7/105* (2013.01)

(58) Field of Classification Search
CPC ..... H01P 7/105; H01P 1/2082; H01P 1/2086
USPC ..... 333/208, 209, 212, 227, 230, 235
See application file for complete search history.

(56) References Cited

U.S. PATENT DOCUMENTS 4,675,630 A * 6/1987 Tang ..... H01P 1/2086 333/208
4,763,089 A 8/1988 Pon
5,349,316 A * 9/1994 Sterns ..... H01P 1/2082 333/135
5,764,115 A * 6/1998 Hattori ..... H01P 1/2086 333/202
5,831,496 A * 11/1998 Sonoda ..... H01P 1/2086 333/202
6,466,768 B1 10/2002 Agahi-Kesheh et al.
7,755,456 B2 7/2010 Salehi
7,956,706 B2 6/2011 Blair et al.
2009/0256651 A1* 10/2009 Salehi ..... H01P 1/2082 333/202

FOREIGN PATENT DOCUMENTS

EP 0188367 B1 5/1993

OTHER PUBLICATIONS

Cameron, et al., "Microwave filters for communication systems", New Jersey: Wiley, 2007, pp. 470-471, 506-513.

(Continued)

*Primary Examiner* — Rakesh Patel
(74) *Attorney, Agent, or Firm* — Bereskin & Parr LLP/S.E.N.C.R.L., s.r.l.; Isis E. Caulder; T. Cameron Gale

(57) ABSTRACT

A triple-band bandpass filter with at least one cavity resonator. Each cavity resonator has the same three orthogonal resonances modes corresponding to three unique resonance frequencies. The three unique resonance frequencies define the passbands of the filter. The filter has an input probe coupled to an input cavity resonator. The filter has an output probe coupled to an output cavity resonator. The input and output probes are shaped to concurrently couple signal waveforms in each of the resonance modes. Coupling probes that can be used as input or output probes are also provided. An inter-cavity coupling operable to concurrently transmit signal waveforms in each of the resonance modes is also provided. The inter-cavity coupling can be used to transmit signals between adjacent cavity resonators in the filter.

20 Claims, 14 Drawing Sheets

(56) References Cited

OTHER PUBLICATIONS

Holme, "Multiple passband filters for satellite applications", in Proc. 20th ALAA Int. Commu. Satellite Syste. Conf. Exhibit, 2002, paper AIAA-2002-1993, pp. 1-4.
Mokhtaari, et al., "Coupling matrix design of dual and triple passband filters", IEEE Trans. Microwave Theory & Tech., 2006, 55(11): 3940-3946.
Zhang, et al., "Dual-band dielectric-resonator filters", IEEE Trans. Microwave Theory & Tech., 2009, 57(7): 1760-1766.
Marcchiarella, et al., "Design techniques for dual pass-band filters", IEEE Trans. Microwave Theory & Tech., 2005, 53(11): 3265-3271.
Chen, et al., "Design of tri-band filters with improved band allocation", IEEE Trans. Microwave Theory & Tech., 2009, 57(7): 1790-1797.
Chen, et al., "Dual-band and triple-band substrate integrated waveguide filters with chebyshev and quasi-elliptical responses", IEEE Trans. Microwave Theory & Tech., 2007, 55(12): 2569-2578.
Ruiz-Cruz, et al., "Triple-conductor combline resonators for dual-band filters with enhanced guard-band selectivity", IEEE Trans. Microwave Theory & Tech., 2012, 60(12): 3969-3979.
Naeem, et al., "A Dual-band bandpass filter with widely separated passbands", IEEE Trans. Microwave Theory & Tech., 2014, 62(3): 450-456.

* cited by examiner

MULTI-BAND BANDPASS FILTER

FIELD

The present subject-matter relates to bandpass filters, and more particularly to multi-band bandpass filters using resonators.

INTRODUCTION

As the scale of data transmission increases, there is growing demand for systems capable of efficiently processing large amounts of data. In telecommunication and satellite communication systems, various services transmit signals in specific frequency bands. As a result, bandpass filters are used to permit signal components in the specific frequency band(s) to be transmitted, while preventing signal components from being transmitted in other frequency bands. In conventional transceiver architecture, the use of different frequency bands can lead to dedicated signal paths for each service/band with multiple cascaded filters.

U.S. Pat. No. 6,466,768 B1 to Agahi-Kesheh et al. purports to disclose a filter system comprising three or more filters, each having different passbands, and an impedance adjusting network coupled between a filter system ports and each of the ports of at least two of the filters to adjust the port impedances of the filters coupled to the network. The adjusted port impedance of each filter at a frequency representative of at least one of the other filters coupled to the network is at a non-loading level. In one embodiment, the filter system is configured for use in a wireless communication receiver and/or handset.

SUMMARY

It would thus be highly desirable to be provided with a device or system that may at least partially address the disadvantages of the existing technologies.

The embodiments described herein provide in an aspect a multi-band bandpass filter. The bandpass filter may include at least one cavity resonator. Each cavity resonator can have three orthogonal resonance modes. The three orthogonal resonance modes can include a first resonance mode, a second resonance mode and a third resonance mode. Each resonance mode may have a corresponding unique resonance frequency. The unique resonance frequencies corresponding to the resonance modes may define passbands of the bandpass filter. The three unique resonance frequencies corresponding to the three orthogonal resonance modes may define three passbands of the bandpass filter. The filter may include an input probe coupled to an input cavity resonator of the at least one cavity resonator. The input probe may be shaped to concurrently couple input signal waveforms into the input cavity resonator in each of the first resonance mode, the second resonance mode and the third resonance mode. The filter may include an output probe coupled to an output cavity resonator of the at least one cavity resonator. The output probe may be shaped to be concurrently excitable by signal waveforms in the output cavity resonator in each of the first resonance mode, the second resonance mode and the third resonance mode.

In some examples, the at least one cavity resonator may include a plurality of cavity resonators. The plurality of cavity resonators can be coupled in a sequence from the input cavity resonator to the output cavity resonator. The filter may include an inter-cavity coupling between the cavity resonators in the sequence. The inter-cavity coupling may be operable to concurrently transmit signal waveforms in each of the resonance modes between adjacent cavity resonators in the sequence. Each cavity resonator can have the same three orthogonal resonances modes corresponding to same three unique resonance frequencies.

In some examples, the three orthogonal resonance modes can be intrinsic resonance modes of each cavity resonator.

In some examples, the inter-cavity coupling may include at least one window section. Each window section may be shaped to transmit signal waveforms in a window-specific mode of the resonance modes between the adjacent cavity resonators.

In some examples, the at least one window section may include a first window section and a second window section. The second window section may be substantially perpendicular to the first window section.

In some examples, the first window section and the second window section may intersect.

In some examples, the first window section and the second window section may define a cross-shaped window.

In some examples, each of the window sections may be substantially rectangular.

In some examples, the inter-cavity coupling may include a conductive probe. The conductive probe may be shaped to transmit signal waveforms in a probe mode of the resonance modes between the adjacent cavity resonators. The conductive probe may extend through at least one particular window section of the at least one window section.

In some examples, the conductive probe may extend substantially perpendicularly through the at least one particular window section.

In some examples, the filter may include an adjustment member coupled to the conductive probe. The adjustment member may be movable to adjust a position of the conductive probe. The adjustment member may be movable to adjust a position of the conductive probe within the at least one particular window section.

In some examples, the input probe may include a first probe portion connectable to an external interface extending through an exterior of the input cavity resonator. The external interface may extend through the exterior of the input cavity resonator along a first axis and the first probe portion may extend along the first axis. The input probe may include a second probe portion positioned within the input cavity resonator. The second probe portion may extend from the first probe portion in a direction substantially perpendicular to the first probe portion. The first probe portion and second probe portion may define an L-shaped input probe. The first probe portion and second probe portion may both be contained within the cavity resonator.

In some examples, the output probe may include a first probe portion connectable to an external interface extending through an exterior of the output cavity resonator. The external interface may extend through the exterior of the output cavity resonator along a first axis and the first probe portion may extend along the first axis. The output probe may include a second probe portion positioned within the output cavity resonator. The second probe portion may extend from the first probe portion in a direction substantially perpendicular to the first probe portion. The first probe portion and second probe portion may define an L-shaped output probe. The first probe portion and second probe portion may both be contained within the cavity resonator.

In some examples, the input probe may include a first input probe portion extending through an exterior of the input cavity resonator. The input probe may include a second input probe portion positioned within the input cavity resonator. The second input probe portion may extend from the first input probe portion in a direction substantially perpendicular to the first input probe portion. The first input probe portion and second input probe portion may define an input L-shaped input probe.

In some examples, the output probe and the input probe may be substantially identical.

In some examples, each cavity resonator may have at least one exterior wall substantially surrounding an enclosed space. The at least one exterior wall may define three perpendicular dimensions of the enclosed space. At least two of the perpendicular dimensions can be a different size.

In some examples, the dimensions of the enclosed space may substantially define the resonance frequencies corresponding to the three orthogonal resonance modes.

In some examples, each cavity resonator may be a non-cubic rectangular parallelepiped. Each of the perpendicular dimensions can be a different size.

In some examples, each cavity resonator may be an elliptic cylinder.

In some examples, each cavity resonator may include a plurality of cavity adjustment members. Each cavity adjustment member may be operable to adjust one of the dimensions of the enclosed space.

In some examples, the plurality of cavity resonators may include at least one intermediate cavity resonator. The intermediate cavity resonator may be positioned in the sequence between the input cavity resonator and the output cavity resonator.

In some examples, the filter may include a housing substantially enclosing the plurality of cavity resonators.

In some examples, the filter may include individual filter units having three concurrent passband frequencies. Three passbands of the filter may be defined using a single or individual filter unit. In some examples, multiple individual filter units may be used, with each filter unit having substantially the same passband frequencies.

In some examples, the filter may provide a concurrent signal path for three passbands. The concurrent signal path may provide substantially non-interacting signal paths for signal waveforms corresponding to each passband. The concurrent signal path may transmit signal waveforms corresponding to each passband without requiring physically separate signal transmission paths, or cascaded filtering.

The embodiments described herein provide in an aspect an inter-cavity coupling for a multi-band bandpass filter. The inter-cavity coupling may be used with a multi-band bandpass filter having at least two cavity resonators. Each cavity resonator may three orthogonal resonance modes. Each orthogonal resonance mode may have a unique resonant frequency. The unique resonant frequencies may define passbands of the filter. The inter-cavity coupling may include at least one window section between two adjacent cavity resonators. Each window section may be shaped to transmit signal waveforms in a window-specific resonance mode between the adjacent cavity resonators. The inter-cavity coupling may include a conductive probe. The conductive probe may be shaped to transmit signal waveforms in a probe resonance mode between the adjacent cavity resonators. The conductive probe may extend through at least one particular window section of the at least one window section. The coupling may be operable to concurrently transmit signal waveforms between the adjacent cavity resonators in each of the resonance modes.

In some examples, the at least one window section may include a first window section and a second window section. The second window section may be substantially perpendicular to the first window section.

In some examples, each of the first window section and the second window section may be substantially rectangular.

In some examples, the first window section and the second window section may intersect.

In some examples, the first window section and the second window section may define a cross-shaped window.

In some examples, the conductive probe may extend substantially perpendicularly through the at least one particular window section.

In some examples, the coupling may also include an adjustment member coupled to the conductive probe. The adjustment member may extend through an exterior of the filter. The adjustment member may be movable to adjust a position of the conductive probe. The adjustment member may be movable to adjust a position of the conductive probe within the at least one particular window section.

The embodiments described herein provide in an aspect a coupling probe for a multi-band bandpass filter. The probe may be an input probe or output probe for a multi-band bandpass filter. The bandpass filter may include a multi-mode cavity resonator with a plurality of resonance modes. The probe may include a first probe portion connectable to an external interface extending through an exterior of the cavity resonator. The external interface may extend through the exterior of the cavity resonator along a first axis and the first probe portion may extend along the first axis. The probe may include a second probe portion positionable within the cavity resonator. The first probe portion and second probe portion may both be contained within the cavity resonator. The second probe portion may extend from the first probe portion in a direction substantially perpendicular to the first probe portion. The first probe portion and second probe portion may define an L-shaped probe. The probe may be concurrently excitable by signal waveforms in each resonance mode of the plurality of the resonance modes.

The first probe portion and second probe portion may both be contained within the cavity resonator.

It will be appreciated by a person skilled in the art that a bandpass filter may include any one or more of the features contained herein and that the features may be used in any particular combination or sub-combination suitable for a bandpass filter and/or filter component.

DRAWINGS

For a better understanding of the embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

Figure 1A:
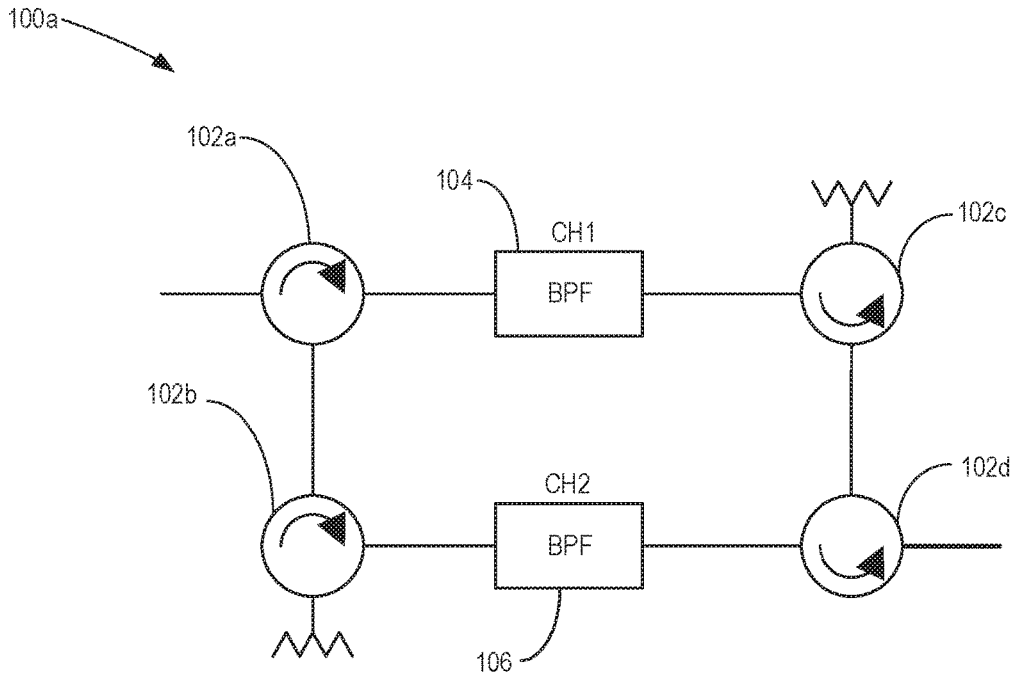
FIG. 1A (Prior Art)
FIG. 1A illustrates an example equivalent circuit diagram of a multi-band bandpass filter using circulators according to the Prior Art.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

In the description and drawings herein, reference may be made to a Cartesian co-ordinate system in which the vertical direction, or z-axis, extends in an up and down orientation from bottom to top. The x-axis extends in a first horizontal or width dimension perpendicular to the z-axis, and the y-axis extends cross-wise horizontally relative to the x-axis in a second horizontal or length dimension.

In conventional transceiver architectures, the use of different frequency bands can lead to dedicated signal paths for each service. This can result in large volume transceiver configurations, increased mass and high insertion loss. As multiple services using several frequency bands are being developed, the demand for highly integrated multi-band filters to further improve the RF/microwave front-ends is increasing.

Filters designed for multiple passbands may include different filters (or filter units) cascaded or in parallel each with individual passbands. These individual bandpass filters may be combined to provide a bandpass filter with multiple passbands. Such multi-band filters tend to be bulky and heavy. It can also be difficult to design such filters for greater numbers of passbands.

Waveguide resonators can provide useful signal transmission attributes, such as low loss, high power handling and a wide spurious-free window. However, there are still difficulties in manufacturing bandpass filter with a plurality of passbands because of the challenges involved in collecting the distinct signal paths within the resonator structure. Accordingly, to implement a triple-band bandpass filter using resonators, a broadband bandpass filter and two bandstop filters have been cascaded (i.e. 3 separate cascaded filter units). Again, this approach often results in increased mass and size.

In satellite communication systems, multi-band filters may be used to transmit multiple non-contiguous channels to the same geographic region in one beam. A high-power amplifier can be connected to the multi-band filter to provide a simply system architecture. Such systems may find applications in fixed-satellite service and high-throughput satellite systems.

Embodiments described herein may provide multi-band bandpass filters and/or related filter components that address one or more difficulties associated with previous approaches to implementing multi-band bandpass filters. Embodiments described herein may also provide methods for manufacturing a triple-band filter and/or related filter components.

In general, embodiments described herein relate to multi-band bandpass filters using cavity resonators. In embodiments herein, a cavity resonator can be shaped to define three intrinsic resonance modes each with different (i.e. unique) resonance frequencies. The resonance frequencies of the cavity resonator can define the passbands of a multi-band bandpass filter. Accordingly, embodiments described herein may provide cavity resonator filters with three passbands defined by three different resonances frequencies corresponding to intrinsic orthogonal resonance modes of the cavity resonators.

In general, the cavity resonators can be shaped to define an enclosed space that is substantially empty or void. The dimensions of the enclosed space can substantially define the resonance frequencies corresponding to the plurality of resonance modes. In some cases, the cavity resonators can define a substantially void enclosed space and signal coupling components for the filter may be positioned within the enclosed space. The dimensions of the enclosed space can still substantially define the resonance frequencies. For example, the dimensions may be adjusted while accounting for perturbations caused by signal coupling components positioned within the cavity.

Various shapes of cavity resonators can be used in the embodiments described herein. For example, in some embodiments a cavity resonator may be shaped as a non-cubic rectangular parallelepiped. In some embodiments, cavity resonators may be shaped as elliptic cylinders.

Cavity resonators in embodiments described herein can be manufactured of conductive materials. For example, materials such as Gold, Silver, Copper, Aluminum etc. may be used to manufacture cavity resonators in embodiments described herein.

In embodiments herein, one or more cavity resonators can be used in a multi-band bandpass filter. In some cases, a plurality of cavity resonators can be coupled in a sequence from an input cavity resonator to an output cavity resonator. Each of the cavity resonators can be shaped to define its three intrinsic modes to correspond to the unique resonance frequencies. In general, the shape of the cavity resonators in the sequence will be substantially similar. However, minor modifications may be made for individual cavity resonators, for example to account for loading effects or other factors that may affect the resonant frequency of the cavity resonator.

Exciting multiple modes in a cavity can be a significant challenge. A coaxial cable extending perpendicularly into a cavity may often be used to couple signals to a single mode of the cavity. Previous approaches to exciting multiple modes may be limited to one or two modes. As well, independent control of the external Q-factor of each channel can be quite limited.

Embodiments described herein may also provide a coupling probe for a multi-band bandpass filter. In some cases, the coupling probe may be used as an input probe between an input cavity resonator and an input signal path. In some cases, the coupling probe may be used as an output probe between an output cavity resonator and an output signal path. In embodiments described herein, the coupling probe can be shaped to concurrently coupled signal waveforms in each of the resonance modes (and corresponding resonance frequencies) into and/or out of a cavity resonator.

The coupling probe may include a first probe portion connectable to an external interface. The external interface may extend through an exterior of a cavity resonator (e.g. an input cavity resonator or an output cavity resonator) along a first axis (i.e. extend into the cavity along a first axis). The first probe portion may extend from the external interface along the first axis. The coupling probe can also include a second probe portion extending from the first probe portion in a direction substantially perpendicular to the first probe portion. The first probe portion and second probe portion of the coupling probe may thus define an L-shaped coupling probe.

The first probe portion may include an external signal path connection that is operable to couple the probe to an external signal path (e.g. an input signal path and/or an output signal path). The first probe portion may be positioned entirely within the cavity resonator. The second probe portion may be positioned within the cavity resonator. The dimensions of the first probe portion and second probe portion may be adjusted based on signal coupling values. For example, the signal coupling values may be determined using a circuit model of a multi-band filter.

In some embodiments, the input coupling probe and output coupling probe may be substantially identical. That is, the input coupling probe and output coupling probe may have the same (or substantially the same) dimensions in some embodiments. In some embodiments, the input and output coupling values for a particular filter may differ.

For example, in some embodiments a multi-band bandpass filter may be coupled to other components (e.g. a multi-port junction) to provide a more complex signal response. In such embodiments, the filter may not be symmetrical as the input signal path may be connected to the other components (e.g. multi-port junction) while the output signal path is floating. Accordingly, the shape of the input probe may be modified as compared to the output probe or vice versa.

The specific dimensions of the first probe portion and second probe portion for each of the input probe and the output probe may be adjusted based on the desired signal coupling values or filter applications. Again, the signal coupling values may be determined, for example, using a circuit model of a multi-band filter.

Embodiments described herein may also provide an inter-cavity coupling between cavity resonators. In general, the inter-cavity coupling described in embodiments herein can be shaped to concurrently transmit signal waveforms in each of the orthogonal resonance modes (and corresponding resonance frequencies) between adjacent cavity resonators. An inter-cavity coupling can be positioned between a cavity resonator and each cavity resonator that is adjacent thereto in the sequence of cavity resonators (i.e. between a cavity resonator and the previous cavity resonator before it in the sequence and/or between the cavity resonator and the subsequent cavity resonator after it in the sequence). In other words, each cavity resonator may have a sequence position in the sequence of cavity resonators from the input or first cavity resonator to the output or last cavity resonator. An inter-cavity coupling can be positioned between a cavity resonator (having a particular sequence position) and the cavity resonators whose sequence position is adjacent to that particular sequence position in the sequence.

The inter-cavity coupling may include at least one window section. In some cases, each window section can be shaped to transmit signal waveforms in a window-specific mode of the orthogonal resonance modes between the adjacent cavity resonators. In some cases, each of the window sections can be substantially rectangular in shape.

In some embodiments, the at least one window section may define a multi-mode window section. The multi-mode window section may be shaped to transmit signal waveforms in at least two window-specific modes of the orthogonal resonance modes between the adjacent cavity resonators.

For example, the at least one window section may define a rectangular multi-mode window section with length=a, and width=b. If a and b are close (e.g. $a/b<2$), and the center of the multi-mode window section is offset from the cavity center (i.e. offset from the center of the wall between adjacent resonators), the multi-mode window section may be capable of transmitting three resonance modes simultaneously. However, the coupling strength of the three resonance modes in such a multi-mode window section would be all different.

A multi-mode window section may transmit signal waveforms in the at least two window-specific modes without causing interactions between those modes/channels. In some cases, however, using a multi-mode window may degrade the ability to independently control the coupling strength for each window-specific mode of the at least two window-specific modes.

The window sections may include a pair of window sections. Each window section may transmit signal waveforms in one (i.e. a window-specific mode) of the orthogonal resonance modes (and corresponding resonance frequencies) between the adjacent cavity resonators.

The at least one window section may include a first window section and a second window section substantially perpendicular to the first window section. In some cases, the first window section and the second window section may intersect. For example, the first window section and the second window section may define a substantially cross-shaped window.

The inter-cavity coupling can also include a conductive probe extending between the adjacent cavity resonators. The conductive probe may extend into each of the adjacent cavity resonators. The conductive probe can be shaped to transmit signal waveforms in a probe mode of the orthogonal resonance modes between the adjacent cavity resonators. In some cases, the conductive probe may extend through a particular window portion of the at least one window section. For example, the conductive probe may extend substantially perpendicularly through the at least one window section.

In general, embodiments herein may provide a triple-band filter structure with 3 filter passbands. The embodiments described herein may employ cavity resonator filter structures shaped to define the 3 filter passbands. The embodiments described herein may thus a triple-band filter configured to control the 3 passbands without requiring individual filters corresponding to 1 or 2 passbands to be combined or cascaded. That is, the individual filter units (e.g. individual cavity resonators) used in embodiments herein may each be configured to control the 3 passbands of the filter. The embodiments described herein may also provide coupling components usable with the cavity filter structure to control signal distribution to all 3 passbands.

In the embodiments described herein, the cavity resonators can define independent orthogonal resonances modes. The independent orthogonal resonances modes may provide substantially non-interacting signal paths for signal waveforms corresponding to each passband. As the signal paths may not interact (or may interact minimally) each of the signal paths/channels may be considered similar to a single filter for that passband.

Accordingly, in embodiments of a multi-band filter described herein, wide separation of individual passband channels may be attained while providing a filter with a compact size and reduced footprint. Embodiments of the inter-cavity coupling described herein may facilitate the separate coupling of the individual passband channels between adjacent cavity resonators. Similarly, embodiments of the coupling probe described herein may facilitate independently coupling signals in the individual passband channels into and/or out of the filter structure.

Embodiments described herein may be suitable for implementations in various signal transmission systems requiring multi-band bandpass filters. For example, embodiments described herein may be used to transmit multiple non-contiguous channels to the same region in one beam.

Embodiments described herein may provide filters and filter components for filters from UHF frequency bands to Ka frequency bands. Embodiments described herein may operate with resonant frequencies within a frequency range from about 300 MHz to about 30 GHz.

Embodiments described herein may provide passbands with passband bandwidths less than 4% of the frequency of the passband. Some Embodiments described herein may provide passbands with passband bandwidths less than 2% of the frequency of the passband.

Some embodiments described herein may operate with low-power and medium power operations. For example, embodiments using TNC coaxial connectors may operate with an average power of several tens Watts. Some embodiments described herein may operate with an average power level of over hundred watts with suitable modifications to the connectors.

Referring now to FIG. 1A, shown therein is a diagram of an equivalent circuit 100*a* representing an example of a multi-band bandpass filter implemented using multiple filter units with different passbands. A bandpass filter corresponding to circuit 100*a* may have a pair of passbands implemented using a pair of single-band bandpass filters 104 and 106. A plurality of circulators 102*a*-102*d* couple the signals along the first channel CH1 and the second channel CH2.

A filter corresponding to circuit 100*a* may require additional insertion loss as a result of the circulators 102*a*-102*d*. Additionally, the insertion loss from each channel may not be balanced because of different circulation channels along the path. The use of circulators 102*a*-102*d* may also result in increased size (i.e. footprint) of a filter corresponding to circuit 100*a*. Similarly, the circulator may contribute to an increase in mass. An increased component cost may also result because of the circulators 102*a*-102*d*.

Figure 1B:
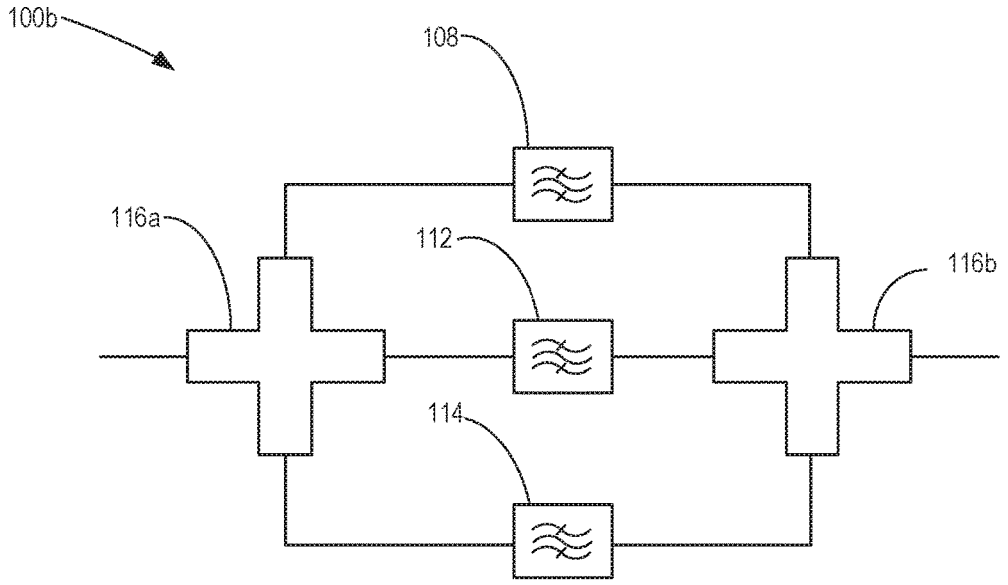
FIG. 1B (Prior Art)
FIG. 1B illustrates an example equivalent circuit diagram of a multi-band bandpass filter using multi-port junctions according to the Prior Art.

Referring now to FIG. 1B, shown therein is a diagram of an equivalent circuit 100*b* representing another example of a multi-band bandpass filter implemented using multiple filter units with different passbands. A bandpass filter corresponding to circuit 100*b* may have three passbands implemented using three separate single-band bandpass filters 108, 112 and 114. In circuit 100*b*, the single-band bandpass filters 108, 112 and 114 are connected using multi-port junctions 116*a* and 116*b*.

Designing a filter that corresponds to the equivalent circuit 100*b* can be complex as the individual bandpass channels are presented simultaneously and can interact with each other. Additionally, each channel (including the junctions 116) may be required to have the same length, and input/output waveguide ports may need to have the same orientation. Tuning a filter that corresponds to circuit 100*b* can thus be a time-consuming and expensive process. As the number of channels increases, the junction approach illustrating by circuit 100*b* can become increasingly difficult to implement.

Figure 2:
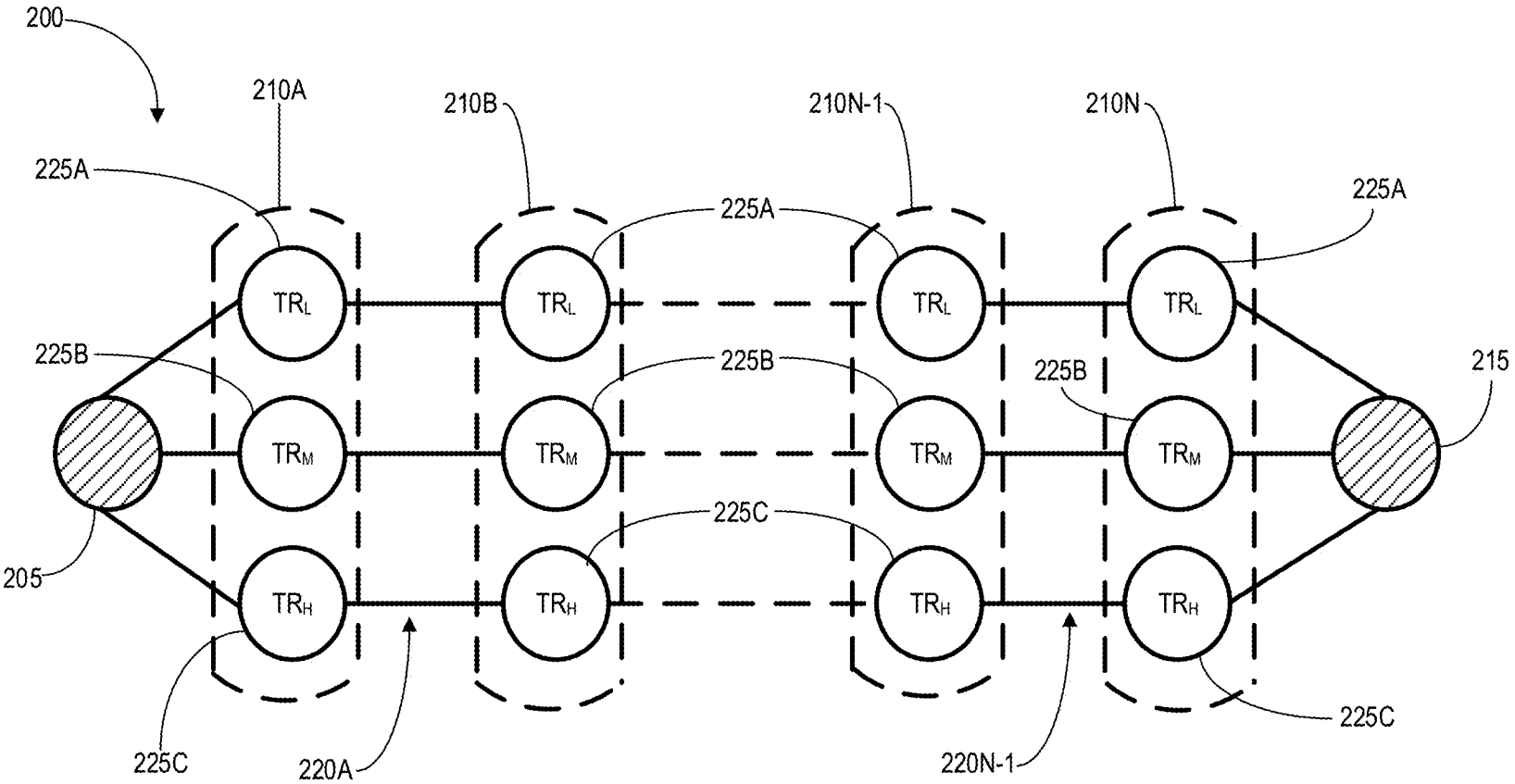
FIG. 2 illustrates an example equivalent circuit diagram of a multi-band bandpass filter in accordance with an example embodiment.

Referring now to FIG. 2, illustrated therein is an example diagram of an equivalent circuit 200 of a multi-band bandpass filter in accordance with an embodiment. The equivalent circuit 200 corresponds to an example of a multi-band bandpass filter using cavity resonators 210A-210N with three orthogonally polarized modes (225A, 225B, and 225C). Each of the orthogonally polarized modes 225A, 225B, and 225C can have a different corresponding resonance frequency.

Each cavity resonator 210 may be referred to as a triple-mode resonator with three modes resonating at different frequencies. The corresponding resonance frequencies can define the passbands of the filter. Accordingly, embodiments of multi-band filters corresponding to circuit 200 can be configured to carry three passbands of signal without requiring separate filters for the different passbands. That is, each cavity resonator 210 may be considered an individual filter unit having three concurrent passband frequencies corresponding to the passbands of the filter. As shown, multiple individual filter units (i.e. cavity resonators 210A-210N) may be used, with each filter unit having substantially the same passband frequencies.

As described below with reference to FIGS. 3 and 4, embodiments of the filters described herein may employ pure cavity resonators as the resonators 210. That is, the resonance modes of the cavity resonators 210 may be three intrinsic cavity modes defined by the resonator cavity (e.g. $TE_{10}$, $TE_{01}$, and $TM_{11}$ modes). The intrinsic modes of an individual cavity resonator 210 may thus be used to generate multiple passbands of the filter 200.

The example equivalent circuit 200 shows three parallel non-interacting paths. In each cavity resonator 210, the three modes 225A, 225B, and 225C are orthogonally polarized. Accordingly, the coupling matrix parameters for the individual passbands of an example triple-band filter corresponding to equivalent circuit 200 may be extracted as individual filters without considering interaction from adjacent bands.

The example equivalent circuit 200 shows a plurality of cavity resonators 210 in a sequence from an input cavity resonator 210A to an output cavity resonator 210N. The circuit 200 also illustrates a plurality of intermediate cavity resonators, such as cavity resonators 210B and 210N-1.

Figure 5A:
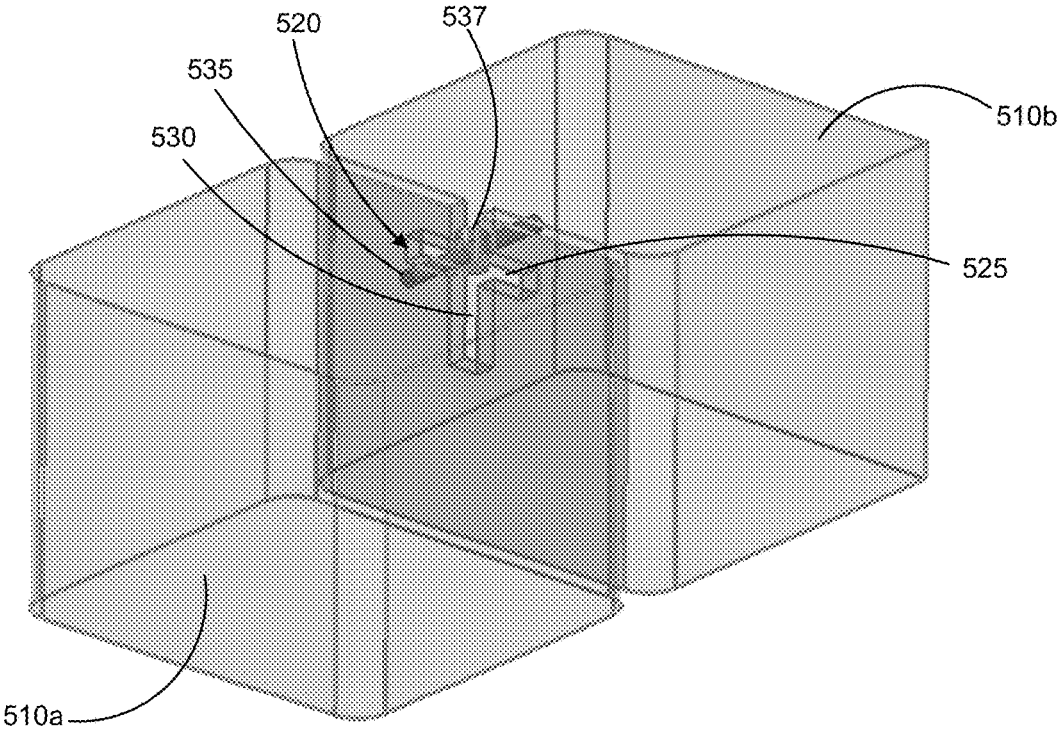
FIG. 5A illustrates an example of a coupling between cavity resonators in accordance with an example embodiment.
Figure 5B:
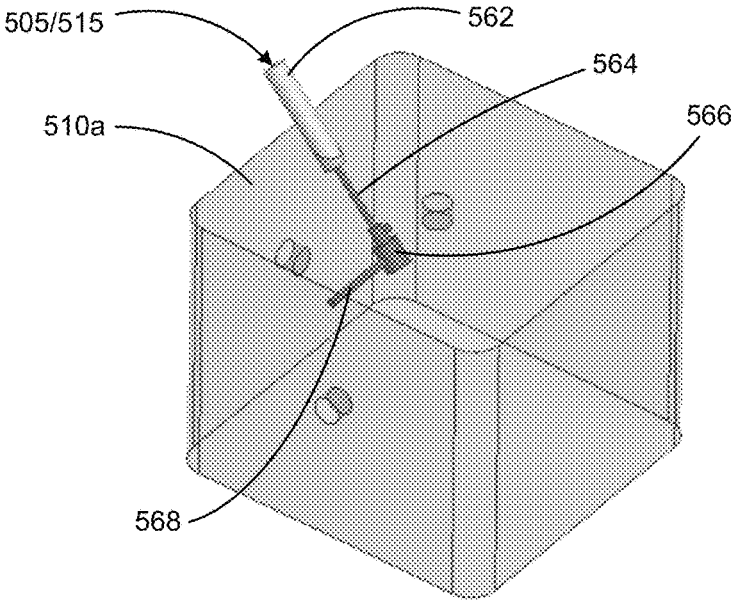
FIG. 5B illustrates a perspective view of an example of a coupling probe in accordance with an example embodiment.
Figure 5C:
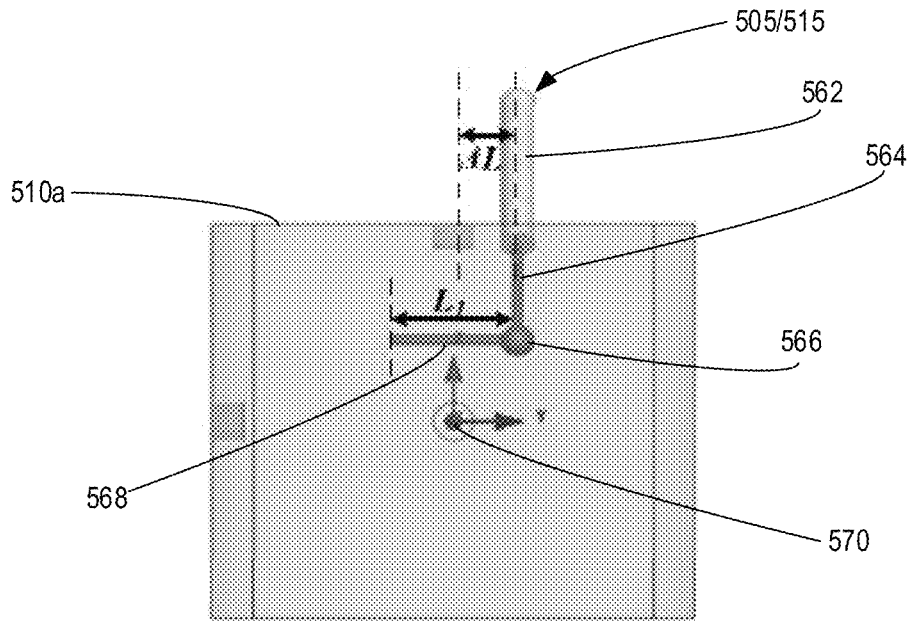
FIG. 5C illustrates a rear view of the example coupling probe of FIG. 5B.
Figure 5D:
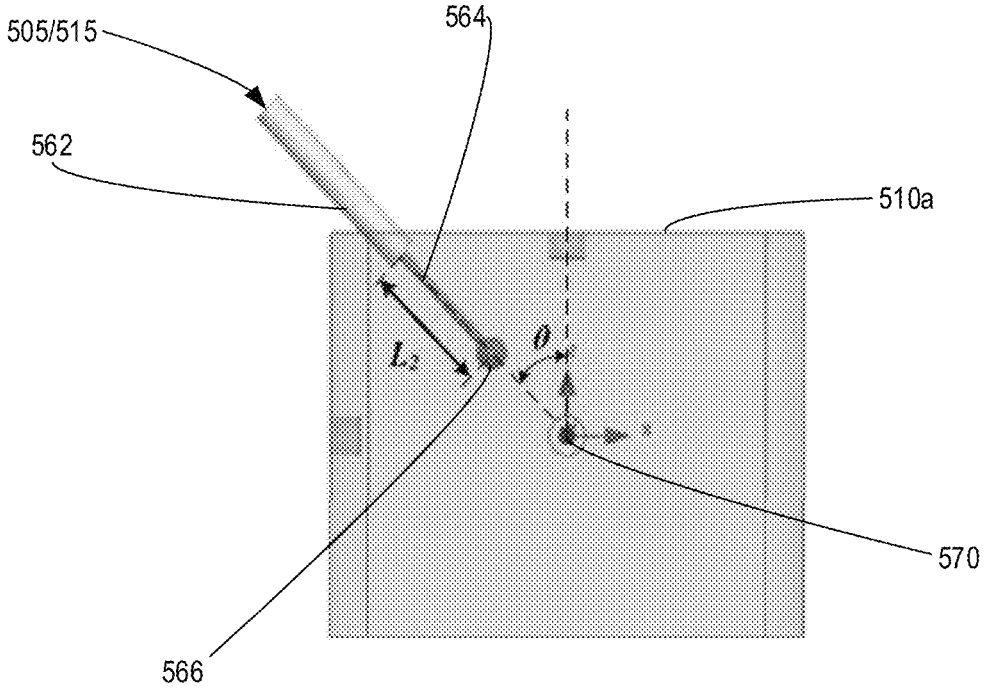
FIG. 5D illustrates a side view of the example coupling probe of FIG. 5B.

The circuit 200 shows the input cavity resonator 210A coupled to a signal input 205. The output cavity resonator 210N is also shown coupled to a signal output 215. The signal input 205 can be coupled to the input cavity resonator 210A by a coupling probe. Similarly, the signal output 215 can be coupled to the output cavity resonator 210N by a coupling probe. The coupling probes may be configured to control signals in the three orthogonal modes substantially simultaneously/concurrently. Example embodiments of such coupling probes are shown in FIGS. 5B-5D and described below.

The circuit 200 also has inter-cavity couplings 220A-220N-1 between adjacent cavity resonators 210. The inter-cavity couplings 220 can be configured to concurrently transmit signals in each of the resonance modes between adjacent cavity resonators 210. The inter-cavity couplings 220 may transmit signals between adjacent cavity resonators with little or no interaction between the signals in the modes (i.e. with minimal coupling between the modes in the high, middle and low branches of the filter circuit 200). This may allow each signal path to be synthesized and designed separately.

Example embodiments of cavity filter structures that may be used to implement a filter with triple-band filtering response are described below with reference to FIGS. 3 and 4. In general, the cavity filter structures shown in FIGS. 3 and 4 include a plurality of resonant cavities. The resonant cavities can be shaped to be resonant in three orthogonal modes, each with different resonant frequencies. The embodiments described herein, such as those shown in FIGS. 3 and 4 may provide well-defined (e.g. narrow) passbands with high Q factors. Some embodiments may provide triple-mode filters that reduce the size/footprint of the filter as compared to implementations of filters that correspond to the circuits shown in FIGS. 1A and 1 B.

Figure 3:
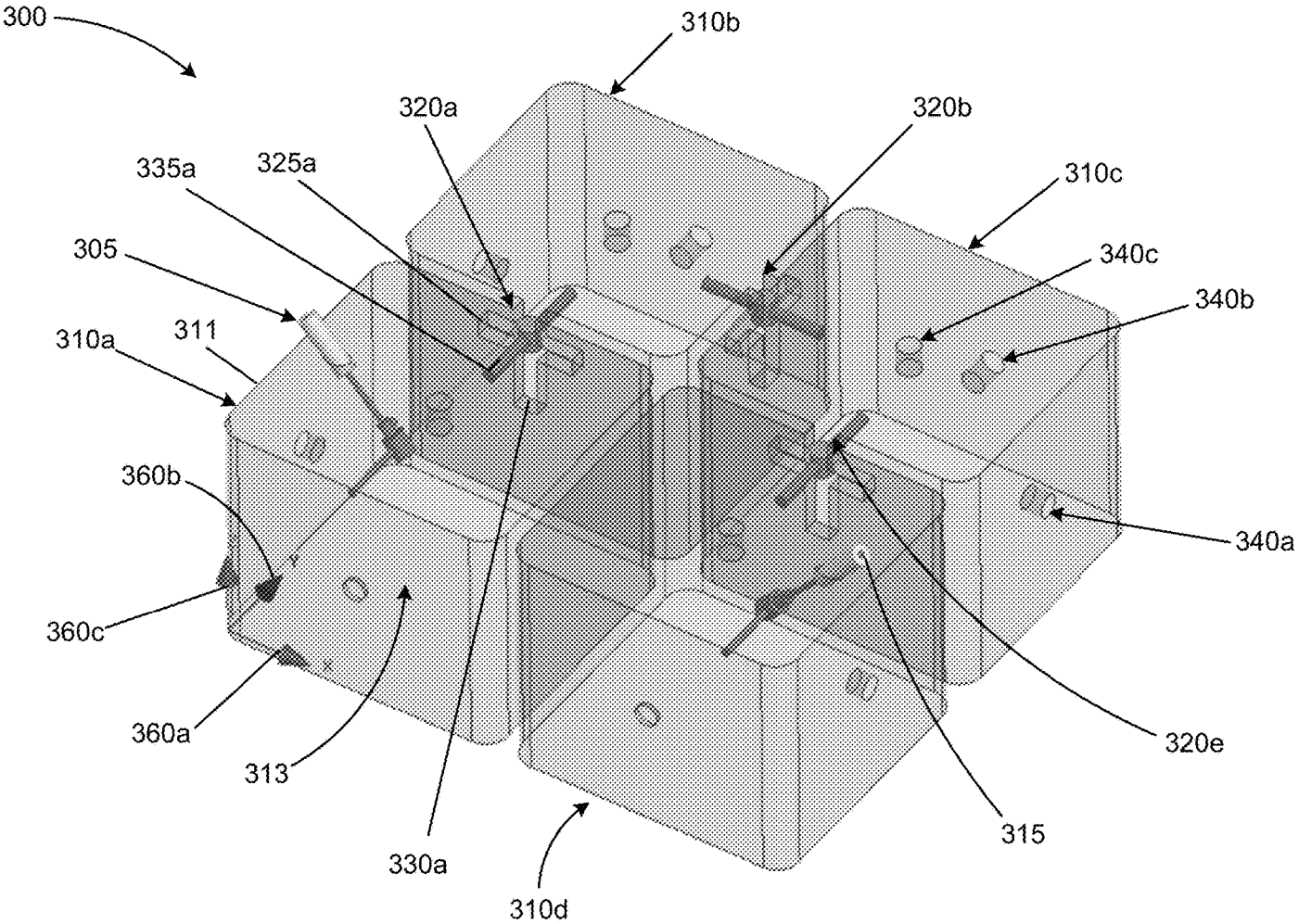
FIG. 3 illustrates an example of a multi-band bandpass filter using cavity resonators in accordance with an example embodiment.

Referring now to FIG. 3, shown therein is an example of a multi-band bandpass filter 300 in accordance with an embodiment. Bandpass filter 300 includes a plurality of cavity resonators 310*a*, 310*b*, 310*c*, 310*d*. The plurality of cavity resonators 310 are coupled in a sequence (310*a*, 310*b*, 310*c*, 310*d*) from an input cavity resonator 310*a* to an output cavity resonator 310*d*. The plurality of cavity resonators 310 also includes intermediate cavity resonators 310*b* and 310*c* positioned in the sequence between the input cavity resonator 310*a* and the output cavity resonator 310*d*.

Each of the cavity resonators 310 has a plurality of resonance modes. Each resonance mode has a corresponding unique resonance frequency. The unique resonance frequencies can define the plurality of passbands of the bandpass filter 300. The plurality of resonance modes can include 3 orthogonal resonance modes. Each of the 3 orthogonal resonance modes can correspond to a unique and different resonance frequency. Accordingly, the filter 300 may have 3 passbands defined by the resonance frequencies of the cavity resonators 310.

The bandpass filter 300 shown in FIG. 3 employs rectangular triple-mode resonant cavities 310. In some cases, the rectangular cavities 310 may be constructed using rectangular waveguide triple-mode resonators. The resonant frequencies may be limited to frequencies within the operational range of the rectangular waveguide structure being used.

The resonance modes and corresponding resonance frequencies of the cavity resonators 310 can be defined as the intrinsic resonance modes of each cavity. Each cavity resonator 310 can have at least one exterior wall 311 that substantially surrounds or defines an enclosed space 313. The dimensions of the enclosed space 313 may substantially define the resonance frequencies corresponding to the plurality of resonance modes.

The walls 311 of each cavity resonator 310 may define three perpendicular dimensions of the space 313 enclosed by cavity resonator 310. The dimensions of the enclosed space can extend in perpendicular directions defined by the x-axis 360*a*, y-axis 360*b* and x-axis 360*c*. In the example shown in FIG. 3, the perpendicular dimensions correspond to faces defined by the walls 311 of the rectangular cavity resonators 310.

The perpendicular dimensions of the rectangular cavity resonators 310 can be defined so that each dimension is a different size. Accordingly, the rectangular cavity resonators 310 may be shaped as non-cubic rectangular parallelepiped. That is, the width, length and height of each cavity resonator 310 can be different from each other. The sides or faces of the cavity resonators 310 may each be non-cubic. This may facilitate splitting of signals corresponding to the different resonant frequencies.

In filter 300, the cavity resonators 310 may be triple-mode resonators operating in $TE_{101}$, $TE_{011}$ and $TM_{110}$ modes. For a rectangular waveguide resonator 310 with width "a", height "b" and length "d", increasing "b" dimension can improve the quality ("Q") factor of the $TE_{101}$ mode. Increasing the "b" dimension may also decrease the spurious free window as the cut-off frequency of the $TE_{101}$ mode (i.e. the first spurious mode after increasing "b") shifts closer to the pass band.

In embodiments of filter 300, the original spurious-modes $TE_{011}$ and $TM_{110}$ can be employed in parallel with the $TE_{101}$ mode as three pass-bands frequencies. Accordingly, the "b" dimensions can be increased in the triple-mode cavities resulting higher Q for all channels. While this may result in some degradation of the spurious performance as a result of the cut-off frequency of the next resonant mode (e.g. $TE_{111}$) also drifting toward the passband, the next resonant mode may have a cut-off frequency substantially different from those of the passbands to be considered an acceptable spurious-free window.

The dimensions of the individual cavity resonators 310 can be adjusted to define the resonant frequencies of the resonator, and in turn the passbands of the filter. In some cases, the dimensions of the cavity resonators 310 may be determined using equation (1):

$$f_{mnl} = \frac{c}{2\pi\sqrt{\mu_r\varepsilon_r}}\sqrt{\left(\frac{m\pi}{a}\right)^2+\left(\frac{n\pi}{b}\right)^2+\left(\frac{l\pi}{d}\right)^2} \quad (1)$$

where c represents the speed of light in free space 313 enclosed by cavity resonator 310; a, b and d represent the perpendicular dimensions of the cavity resonator 310; indices m, n, l represent the number of half wave patterns along the x, y and z dimensions respectively for a particular resonant frequency f; μ is the permeability of the cavity, and ε is the permittivity of the cavity.

Equation (1) defines a relationship between the resonant frequencies f of a rectangular waveguide cavity structure such as the cavity resonators 310 and the dimensions a, b and d of that rectangular waveguide cavity structure. In general, for a rectangular waveguide resonator structure, the resonant frequency of a transverse electric (TE) or transverse magnetic (TM) mode can be uniquely determined by a corresponding resonant wave number.

While the dimensions of the individual cavity resonators 310 will typically be substantially similar or identical, in some cases minor modifications may be made to account for loading effects on individual resonators 310. For example, in a filter that uses a sequence of 10 cavity resonators, the dimensions of the resonators may have dimensions substantially corresponding to the following relative sizes: first cavity resonator=last cavity resonator<second cavity resonator=second to last cavity resonator<third cavity resonator=third to last cavity resonator<fourth cavity resonator=fourth to last cavity resonator<fifth cavity resonator=fifth to last cavity resonator.

In general, the cavity resonators 310 define an enclosed space 313 that is substantially void. However, as shown in filter 300, coupling components may be positioned within the enclosed space 313. For example, the input cavity resonator 310*a* has an input coupling probe 305 positioned at least partially within the enclosed space 313 of resonator 310*a*. Similarly, the output cavity resonator 310*d* has an output coupling probe 315 positioned at least partially within the enclosed space 313 of resonator 310*d*. The probes 305/315 may disturb the resonant frequencies within those cavities. Accordingly, the dimensions of the cavity resonators 310*a* and 310*d* can be adjusted to account for the perturbations while defining the same resonant frequencies of the resonators.

For example, the impact on the resonant frequencies (i.e. the loading effect causing a frequency offset) of positioning a probe 305/315 within a cavity resonator 310 may be determined using electromagnetic simulation software, such as Ansys HFSS. The determined frequency offset may then be added to equation (1) to determine the modified dimensions of the cavity resonator 310.

Figure 7:
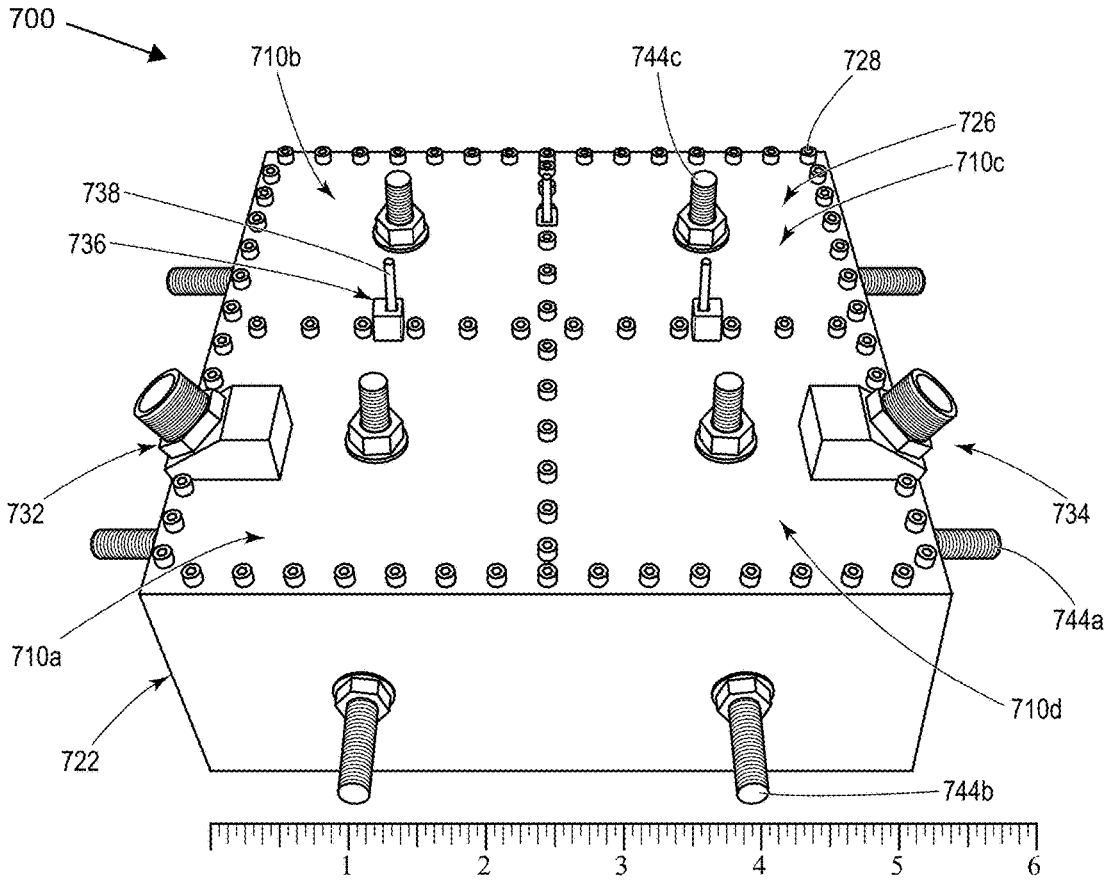
FIG. 7 illustrates an example implementation of a multi-band bandpass filter in accordance with an embodiment.

In some embodiments, the cavity resonators 310 may each have one or more cavity adjustment members (not shown in FIG. 3). Examples of cavity adjustment members are shown in FIG. 7 and described below. A cavity adjustment member may be operated to adjust the dimensions of the space 313 enclosed by a cavity resonator 310. Adjusting dimensions of the cavity resonator 310 may allow the resonant frequency or frequencies of that resonator 310 to be adjusted. For example, the pass bands of the cavity resonators 310 may be modified (e.g. fine-tuned) using the cavity adjustment members.

In some cases, each cavity resonator 310 may have a plurality of cavity adjustment members. The plurality of cavity adjustment members may include an adjustment member for each dimension of the cavity resonator 310. Accordingly, each adjustment member may be used to adjust one of the dimensions of the cavity resonator 310.

As shown in filter 300, each cavity resonator 310 may have one or more vias or holes 340*a*-340*c* through which a cavity adjustment member may pass. Each hole 340*a*, 340*b* and 340*c* may correspond to one of the dimensions of the cavity resonator 310. The cavity adjustment members may be movable through hole 340*a*, 340*b* or 340*c* (e.g. inwards or outwards) to adjust the dimensions of the enclosed space 313 of cavity resonator 310. For example, a cavity adjustment member may be a screw that can be moved inward and outward through a hole 340. The corresponding hole 340 may be threaded to allow the screw member to be adjusted more easily.

Embodiments described herein may also include a housing substantially enclosing the plurality of cavity resonators 310. For example, embodiments shown in FIGS. 6A, 6B and 7 and described below illustrate examples of a multi-band bandpass filter such as filter 300 that may be substantially enclosed by a housing.

The filter 300 can also include an inter-cavity coupling 320 between cavity resonators 310 in the sequence of cavity resonators. The inter-cavity coupling 320 can be operable to concurrently transmit signal waveforms in each of the resonance modes between adjacent cavity resonators 310 in the sequence. The inter-cavity coupling 320 may provide independent control of three coupling paths with minimum interaction. An example of the inter-cavity coupling 320 is shown in FIG. 5A and described in more detail below.

The inter-cavity coupling 320 can be positioned between a cavity resonator 310 and each cavity resonator 310 that is adjacent thereto in the sequence of cavity resonators 310. Each cavity resonator 310 may be said to have a sequence position in the sequence of cavity resonators 310 from the input or first cavity resonator 310*a* to the output or last cavity resonator 310*b*. An inter-cavity coupling 320 can be positioned between a cavity resonator such as second cavity resonator 310*b* and the cavity resonators 310*a* and 310*c* whose sequence position is adjacent to second cavity resonator 310b.

As shown in FIG. 3, inter-cavity coupling 320*a* is between the first cavity resonator 310*a* and the second cavity resonator 310b; inter-cavity coupling 320*b* is between the second cavity resonator 310*b* and the third cavity resonator 310*c*; and inter-cavity coupling 320*c* is between the third cavity resonator 310*c* and the fourth cavity resonator 310*d*.

Although first cavity resonator 310*a* is physically adjacent to fourth cavity resonator 310*d* in the folded configuration of filter 300, there is no inter-cavity coupling between cavity resonator 310*a* and cavity resonator 310*d* because they are not adjacent in the sequence. In some embodiments, a cross-coupling window section (e.g. an iris window) may be positioned between cavity resonator 310*a* and cavity resonator 310*d*. The cross-coupling window section may generate cross-coupling M14, which may in turn generate transmission zeros.

In general, the configuration of each inter-cavity coupling 320*a*, 320*b* and 320*c* in example filter 300 can be similar. Each inter-cavity coupling can include a plurality of coupling components 325, 330, and 335. Each coupling component can be configured to couple signal waveforms in a particular resonance mode between the adjacent cavity resonators 310.

As shown in the example filter 300, the inter-cavity coupling 320 can include a first or horizontal window section 325*a*, a second or vertical window section 330*a* and a conductive probe 335*a* extending between the adjacent cavity resonators 310.

For example, the inter-cavity coupling 320 may include an iris window formed by the first window section 325*a* and second window section 330, and a conductive probe 335*a* extending through the iris window.

As mentioned above, the filter 300 can also include an input probe 305 coupled to the input cavity resonator 310*a*. The input probe 305 can be shaped to concurrently couple input signal waveforms into the input cavity resonator 310*a* in each resonance mode (and corresponding resonance frequency) of that cavity resonator 310*a*.

The filter 300 can also include an output probe 315 coupled to the output cavity resonator 310*d*. The output probe 315 can be shaped to be concurrently excitable by signal waveforms in the output cavity resonator 310*d* in each resonance mode (and corresponding resonance frequency) of that cavity resonator 310*d*. An example coupling probe that may be used as an input probe 305 and/or output probe 315 is shown in FIGS. 5B-5D and described in detail further below.

The input probe 305 can be connected to an external interface such as a coaxial RF connector. For example, an SMA (SubMiniature version A) connector or TNC (Threaded Neill-Concelman) connector may be used as the external interface. The output probe 315 may also be connected to a similar external interface. The external interface can couple the filter 300 to input and output signal paths.

In general, a multi-band bandpass filter using cavity resonator construction as described herein may be implemented with any number of cavity resonators. In some cases, a filter using a single cavity resonator may require both an input probe and output probe in that cavity. This may result in increased complexity in determining the desired dimensions of the resonator. Accordingly, in some cases, it may be preferable to include at least two cavity resonators to facilitate the design and configuration of the filter.

The filter 300 shown in the example embodiment of FIG. 3 illustrates a folded configuration of a 4-cavity filter using rectangular triple-mode cavity resonators. The folded configuration can provides a higher-order filter with a compact footprint. Similarly, this configuration may provide the potential to realize transmission zeroes in between passbands to improve near-band oscillation. For example, a cross-coupling window section (e.g. an iris window) positioned between cavity resonator 310*a* and cavity resonator 310*d* may generate one or more transmission zeros between passbands of the filter 300.

In embodiments of filter 300, footprint savings of up to about 60% and volume savings of up to 40% may be achieved as compared to traditional rectangular waveguide filters. In some embodiments, filter 300 may also provide an improvement in Q-factor of 25% or more from the traditional rectangular waveguide filters.

Figure 4:
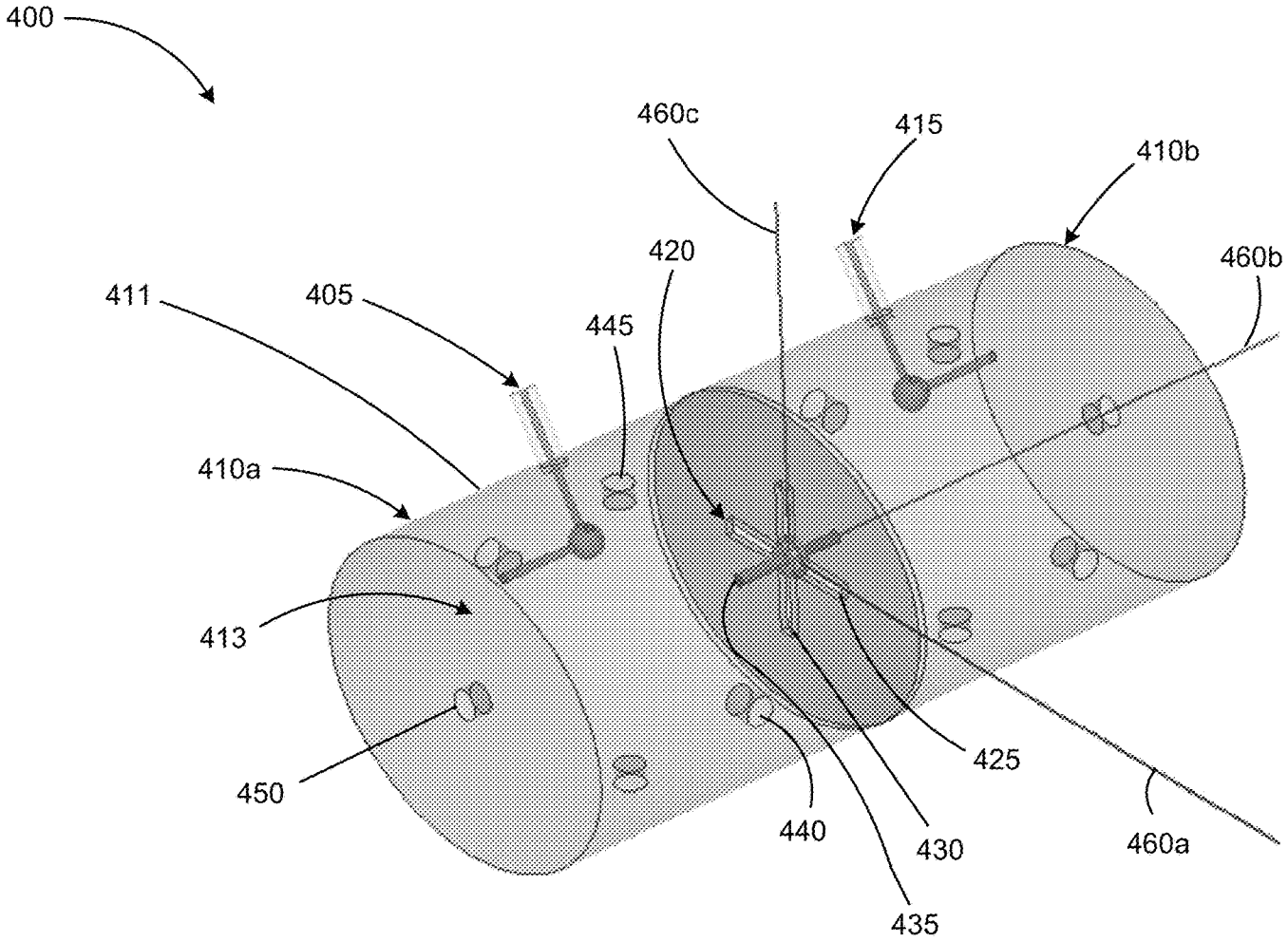
FIG. 4 illustrates another example of a multi-band bandpass filter using cavity resonators in accordance with an example embodiment.

Referring now to FIG. 4, shown therein is another example of a multi-band bandpass filter 400 in accordance with an embodiment. The filter 400 shown in FIG. 4 includes a plurality of cavity resonators 410*a* and 410*b*. The cavity resonators 410*a* and 410*b* are elliptic cylinder cavity resonators. In general, the operation of the bandpass filter 400 may be similar to the bandpass filter 300 shown in FIG. 3.

The cavity resonators 410 in filter 400 each have a plurality of resonance modes (e.g. 3 orthogonal modes) corresponding to unique resonance frequencies. The unique resonance frequencies of the cavity resonators 410 can define the passbands of the filter 400.

Similar to cavity resonators 310, the resonance modes and corresponding resonance frequencies of the cavity resonators 410 can be intrinsic resonance modes of each cavity. Each cavity resonator 410 can have exterior walls 411 that substantially surround or define an enclosed space 413. The dimensions of the enclosed space 413 may substantially define the resonance frequencies corresponding to the plurality of resonance modes.

The dimensions of the individual cavity resonators 410 can be adjusted to define the resonant frequencies of the resonator, and in turn the passbands of the filter. In some cases, the dimensions of the elliptical cavity resonators 410 can be determined using equations (2), (3), and (4):

$$f_{11m_V} \approx \frac{c}{2\pi}\sqrt{\left(\frac{p'_{11}}{a}\right)^2 + \left(\frac{m\pi}{l}\right)^2} \tag{2}$$

$$f_{11m_H} \approx \frac{c}{2\pi}\sqrt{\left(\frac{p'_{11}}{b}\right)^2 + \left(\frac{m\pi}{l}\right)^2} \tag{3}$$

$$f_{01m} \approx \frac{c}{2\pi}\sqrt{\frac{p_{01}^2}{ab} + \left(\frac{m\pi}{l}\right)^2} \tag{4}$$

where c represents the speed of light in the waveguide; a, b and l represent the perpendicular dimensions of the elliptical cavity resonator 410; index m refers to number of the half waveguide length along the z-dimension for a particular resonant frequency f; and p and p' are the roots of J and J' which are related to the roots of Bessel's differential equations for circular waveguides. The values of p and p' for different mode indices may be determined using look-up tables as will be understood by persons skilled in the art.

Equations (2) and (3) define a relationship between the resonant frequencies corresponding to two TE modes and the dimensions of an elliptical cavity resonator 410. Equation (4) defines a relationship between the resonant frequency corresponding to a TM mode and the dimensions of an elliptical cavity resonator. Equations (2), (3) and (4) may be limited to elliptical cavity resonators in which the dimensions a and b (e.g. the maximum radius of the ellipse and minimum radius of the ellipse) are not too different or within a maximum radius ratio. For example, the maximum radius ratio may be defined as a/b<1.2. In the example of filter 400, dimension a corresponds to the radius of a cavity resonator 410 along the dimension 460*a*, b corresponds to the radius of a cavity resonator 410 along the dimension 460*c*, and l corresponds to the length of a cavity resonator 410 along the dimension 460*b*.

The plurality of cavity resonators 410 in bandpass filter 400 includes a pair of cavity resonators 410*a* and 410*b*. Accordingly, the input cavity resonator 410*a* is coupled to an output cavity resonator 410*b*. An input probe 405 similar to input probe 305 is shown coupled to the input cavity resonator 410*a*. An output probe 415 similar to output probe 405 is shown coupled to the output cavity resonator 410*b*. As mentioned above, an example coupling probe that may be used for input probe 405 and/or output probe 415 is shown in FIGS. 5B-5D and described in more detail below.

Bandpass filter 400 also has an inter-cavity coupling 420 configured to concurrently transmit signal waveforms in each of the resonance modes (and corresponding resonance frequencies) between the input cavity resonator 410*a* and output cavity resonator 410*b*. The inter-cavity coupling 420 may be implemented similar to inter-cavity coupling 320. An example of the inter-cavity coupling 420 is shown in FIG. 5A and described in more detail below.

Filter 400 illustrates an in-line filter comprising a plurality of elliptical triple-mode resonators 410. As compared with filter 300 employing rectangular cavity resonators 310, filter 400 may have a slightly higher Q-factor. The $TE_{11n}$ mode in an elliptical waveguide used for elliptical cavity resonators 410 may have a higher Q factor than the $TE_{10n}$ mode in a rectangular waveguide used for rectangular cavity resonators 310.

Implementations of triple-band bandpass filters 400 using elliptical cavity resonators 410 may provide footprint and volume savings of up to and even greater than 30% as compared to traditional cylindrical waveguide filter realizations.

In some cases, each cavity resonator 410 may have a plurality of cavity adjustment members. The plurality of cavity adjustment members may include an adjustment member for each dimension of the cavity resonator 410. As shown in filter 400, each cavity resonator 410 may have one or more vias or holes 440*a*-440*c* through which a cavity adjustment member may pass. The holes 440 may be generally similar to holes 340*a*-340*c*. Similarly, adjustment members used with the cavity resonators 410 may be similar to those used with cavity resonators 310 to adjust a dimension of the cavity resonators 410.

Referring now to FIG. 5A, shown therein is an example of an inter-cavity coupling 520 in accordance with an embodiment. The inter-cavity coupling 520 is configured to concurrently transmit signal waveforms between a first cavity resonator 510*a* and a second cavity resonator 510*b* in each of the resonance modes (and corresponding resonance frequencies) of those cavity resonators 510.

In general, the cavity resonators 510 can be shaped to define three ("3") orthogonal resonance modes. Each of the three orthogonal resonance modes can have a different corresponding resonance frequency. The inter-cavity coupling 520 can concurrently transmit signals in each of those resonance modes (and corresponding resonance frequency). The inter-cavity coupling 520 can be shaped to transmit the signals between adjacent cavity resonators with reduced interaction between couplings in the different paths.

In some embodiments, an inter-cavity coupling 520 having 3 separate coupling components (one for each resonance mode/resonant frequency) may facilitate independent control of coupling for each resonance mode. In other words, the coupling components of inter-cavity coupling 520 may each have independent parameters that control the coupling for a particular path/resonance mode coupling. This may facilitate design and tuning of inter-cavity coupling 520.

An inter-cavity coupling such as the inter-cavity coupling 520 shown in FIG. 5A can include at least one window section. Each window section of the at least one window section can be shaped to transmit signal waveforms in a window-specific mode (of the resonance modes of the cavity resonators 510) between the adjacent cavity resonators 510. For example, the window sections may be formed using irises between adjacent cavity resonators.

In some cases, each of the window sections may be substantially rectangular in shape. Substantially rectangular window sections may facilitate manufacturing of the inter-cavity coupling 520. Window sections that are rectangular in shape may also minimize cross-talk between the orthogonally polarized resonance modes. In some cases, the window sections may be formed as elongated rectangular sections to further minimize the cross-talk between modes.

The inter-cavity coupling 520 can include a first window section 525 and a second window section 530. The first window section 525 and the second window section 530 in the example of coupling 520 are both substantially rectangular in shape. The window sections 525/530 may be shaped as irises between the adjacent cavity resonators 510.

As shown by inter-cavity coupling 520, the first window section 525 can be perpendicular to the second window section 530. In some cases, the first window section 525 and second window section 530 can intersect. For example, the first window section 525 and second window section 530 may intersect and define a cross-shaped window as shown in coupling 520.

In other cases, the first window section 525 and second window section 530 may not intersect. The window sections may be positioned at different locations on the wall between adjacent cavity resonators. In general, the coupling strength of a window section is increased as the window section is positioned closer to the location on the wall between adjacent cavities with a maximum magnetic field. The maximum magnetic field location for a coupling component may depend on the resonance mode being coupled.

In general, a window section corresponding to a particular resonance mode can provide stronger coupling of that resonance mode when the size of the window section is increased. When designing and manufacturing the inter-cavity coupling 520, coupling values for the orthogonal resonance modes can be calculated using EM simulation tools, such as eigenmode simulations in Ansys HFSS. For example, two resonant frequencies $f_1$ and $f_2$ may be simulated in such eigenmode simulations by placing an electric and magnetic wall along the symmetry plane. De-normalized coupling coefficients may then be determined according to:

$$k_1 = \frac{f_2^2 - f_1^2}{f_2^2 + f_1^2} \tag{5}$$

Based on the determined coupling values, the size of the window sections may be adjusted accordingly to provide the desired coupling. In some cases, the position of the window sections may be adjusted to provide the desired coupling values.

The inter-cavity coupling 520 can also include a conductive probe 535. The conductive probe 535 can be shaped to transmit signal waveforms in a probe-specific mode of the resonance modes between the adjacent cavity resonators 510*a* and 510*b*. The conductive probe 535 can extend between the adjacent cavity resonators 510*a* and 510*b*. A portion of the conductive probe 535 may extend into each of the cavity resonators 510*a* and 510*b*. The conductive probe 535 can extend through the at least one window section as shown in FIG. 5A.

In some cases, the conductive probe 535 may extend perpendicularly through the wall between the adjacent cavity resonators 510. In other cases, the conductive probe 535 may extend through the wall between the adjacent cavity resonators 510 at an angle. In general, orienting the probe 535 to be parallel with the electrical field vector of the corresponding resonance mode may provide the most effective coupling of that resonance mode between the adjacent cavity resonators 510.

As mentioned above, coupling values for the orthogonal resonance modes can be determined using EM simulation tools. The conductive probe 535 can be designed to provide the desired coupling values for the corresponding probe mode.

The position of the conductive probe 535 in the wall between the adjacent cavity resonators 510 can affect the coupling strength of the corresponding resonances mode. For example, positioning the conductive probe 535 in the vertical center of the wall between the adjacent cavity resonators 510 can provide increased coupling strength as compared to positioning the probe 535 offset from the vertical center. Similarly, positioning the conductive probe 535 in the horizontal center of the wall between the adjacent cavity resonators 510 can provide increased coupling strength as compared to positioning the probe 535 offset from the horizontal center.

The conductive probe 535 may couple the $TM_{110}$ mode between adjacent cavity resonators 510. The vertical and horizontal center of the wall between the adjacent cavity resonators 510 can be the location corresponding to the strongest Electric field location for the $TM_{110}$ mode.

The size of the conductive probe 535 can also affect the coupling strength of the corresponding resonances mode. In general, a longer conductive probe 535 can provide stronger coupling between the adjacent cavity resonators 510.

An adjustment member 537 may also be coupled to the conductive probe 535. The adjustment member 537 may be movable to adjust the position of the conductive probe 535. For example, the adjustment member 537 may be vertically movable to adjust the position of the probe within the window section 530. The adjustment member 537 may extend through the exterior of the filter to be accessible for adjusting the position of the probe 535.

The inter-cavity coupling 520 shown in FIG. 5A is configured to substantially simultaneously couple three orthogonal modes between the cavity resonator 510*a* and cavity resonator 510*b*. For example, the cavity resonators 510*a* and 510*b* may be resonant in the $TE_{101}$, $TM_{110}$, and $TE_{011}$ modes. The resonance frequencies of the cavity resonators 510*a* and 510*b* in the $TE_{101}$, $TM_{110}$, and $TE_{011}$ modes may define the passbands of a filter implemented using the coupling 520.

The components of the inter-cavity coupling 520 may individually control (or substantially control) coupling of signals corresponding to a particular resonance mode. For example, the cavity resonators 510*a* and 510*b* may operate in the $TE_{101}$, $TM_{110}$, and $TE_{011}$ modes. An inter-cavity coupling 520 that includes a horizontal window section 525, a vertical window section 530 and a conductive probe 535 may have those coupling components couple the $TE_{101}$, $TN_{110}$, and $TE_{011}$ mode respectively. The dimensions of the coupling components may be determined using coupling matrix parameters for the different resonant modes (i.e. the different signal channels). The coupling matrix parameters may be determined using Eigen-mode simulations.

Referring now to FIGS. 5B to 5D, shown therein is an example embodiment of a coupling probe 505/515. FIG. 5B illustrates a perspective view of the coupling probe 505/515 within a cavity resonator 510*a*. FIG. 5C illustrates a rear view of the coupling probe 505/515. FIG. 5D illustrates a side view of the coupling probe 505/515.

The coupling probe 505/515 may be used as an input probe 505 and/or an output probe 515 for a multi-band bandpass filter using a multi-mode cavity resonator 510*a* with a plurality of resonance modes such as filters 200, 300 and 400. The cavity resonator 510*a* may correspond to an input cavity resonator and/or an output cavity resonator.

The multi-mode cavity resonator 510*a* may have three ("3") orthogonally polarized resonance modes each corresponding to a unique resonance frequency. The coupling probe 505/515 may concurrently couple of signals in each of the resonance modes to the cavity resonator 510*a*.

The coupling probe 505/515 can include a first probe portion 564 that is connectable to an external interface 562 extendable through an exterior of the cavity resonator 510*a*. The first probe portion 564 may be attachable to the external interface 562 to couple the coupling probe 505/515 to an input signal path. The external interface 562 may extend into the cavity resonator 510*a* along a first axis or first probe axis. The first probe portion 564 may extend from the external interface 562 into the cavity resonator 510*a* also along the first probe axis.

The coupling probe 505/515 can also include a second probe portion 568 that can be positioned within the cavity resonator 510*a*. The second probe portion 568 can extend from the first probe portion 564 in a direction substantially perpendicular to the first probe portion 564. As shown, the second probe portion 568 can extend from the internal end of first probe portion 564 (i.e. the end opposite the external interface 562). The first probe portion 564 and second probe portion 568 can define an L-shaped probe 505/515. The L-shaped probe 505/515 can be concurrently excitable by signal waveforms in each resonance mode of the plurality of the resonance modes of the cavity resonator 510*a*.

In some cases, the probe 566 may include a probe joint member 566 connecting the first probe portion 564 and the second probe portion 568. The probe joint member 566 may facilitate assembly of the probe 505/515, for instance where the first probe portion 564 and the second probe portion 568 are formed separately. In other cases, the probe joint member 566 may be omitted. For example, if the first probe portion 564 and the second probe portion 568 are manufactured as a unitary probe (i.e. manufactured in one piece) the probe joint member 566 may be omitted.

In general, the probe 505-515 can be manufactured using conductive materials. For example, conductive materials such as gold, silver, copper, aluminum etc. may be used. In some cases, the probe 505-515 may be manufactured using a coaxial cable.

The first probe portion 564 may be coupled to an external interface portion 562, such as a coaxial RF connector (e.g. an SMA or TNC connector). The external interface portion 562 may have a thicker diameter as a result of an outer insulator layer (using materials such as Teflon for example) around an inner conductive layer.

In some cases, a coupling probe 505 can be used as the input probe to an input cavity resonator while a substantially identical coupling probe 515 is used as the output probe from an output cavity resonator. In other cases, the input probe and output probe may be different. For example, different input coupling probes 505 and output coupling probes 515 may be used if the input coupling values and output coupling values for the filter are different.

The configuration of the coupling probe 505/515 may be determined based on the desired input coupling value (for an input probe) or output coupling value (for an output probe). The input coupling value and/or output coupling value for a particular filter can be determined from a circuit model of the filter, such as circuit 200. In some cases, the input coupling value may be different from the output coupling value. In such cases, the configuration of the probes may be different.

The probe 505/515 may have a plurality of probe parameters that may be adjusted to adjust the coupling for that probe. The probe parameters may be adjusted to provide the desired coupling values for the input probe and/or output probe.

The probe parameters can include the length of the second probe portion 568 which is indicated as $L_1$ in FIG. 5C. The probe parameters can also include the length of the first probe portion 564 which is indicated as $L_2$ in FIG. 5D. In some cases, the length $L_2$ of the first probe portion 564 may be adjustable or tunable when the probe is positioned within a cavity resonator 510. For example, the external interface 562 that is coupled to the first probe portion 564 may be adjustable to adjust the length $L_2$ of the first probe portion 564.

The probe parameters can also include a probe insertion angle, which is indicated as θ in FIG. 5D. The probe insertion angle θ may represent an angle between the axis defined by the first probe portion 564 (i.e. extending from the end of the first probe portion 564 which may be referred to as a first probe axis) and the vertical or z-axis of the cavity resonator 510*a* (although referred to as the vertical axis, this axis may be more generally an axis normal to the wall of the cavity through which the first probe portion 564 passes). The probe parameters may also include a probe offset, which is indicated as ΔL in FIG. 5C. The probe offset may indicate the displacement or offset of the first probe portion 564 (or first probe axis) from the center 570 of the cavity resonator 510*a*. The probe insertion angle θ and probe offset ΔL can be used to determine the location of the probe interface 562 at the exterior wall of cavity 510*a*.

The cavity resonator 510*a* may be resonant in the $TM_{110}$, $TE_{101}$ and $TE_{011}$ modes. The coupling probe 505/515 may be configured to concurrently coupled signals into the cavity resonator 510*a* in each of the $TM_{110}$, $TE_{101}$ and $TE_{011}$ modes. Adjusting one or more of the probe parameters may allow the coupling to individual modes to be independently controlled. This may provide an input probe with a simple construction that allows for tuned control of coupling to the three orthogonal modes. For example, coupling to the individual modes may be balanced by adjusting the probe parameters.

Depending on the particular mode whose coupling strength is to be adjusted, different parameters may be modified. For example, the $L_1$ parameter may be adjusted to adjust the coupling strength to the $TM_{110}$ mode. In some cases, the $L_2$ parameter may be adjusted to adjust the overall coupling to the $TE_{101}$ and $TE_{011}$ modes. In some cases, the ΔL parameter may be adjusted to adjust the overall coupling to the $TE_{101}$ and $TE_{011}$ modes. For example, both the $L_2$ and ΔL parameters may be modified to adjust the overall coupling to the $TE_{101}$ and $TE_{011}$ modes. The θ parameter may be adjusted to adjust the distribution of the overall coupling between the $TE_{101}$ and $TE_{011}$ modes.

As shown in table 1 below, the relationships between various probe parameters and the coupling strengths of different modes can be used to adjust the coupling strength to each of the resonance modes. For example, to increase the input/output coupling of the $TE_{101}$ mode and decrease the coupling of the $TE_{011}$ mode, the θ parameter may be increased. In other instances, when the $L_1$ parameter is decreased, the coupling to the $TE_{101}$ mode will decrease while the coupling to the $TM_{110}$ and $TE_{011}$ modes will increase.

TABLE 1

Relationship between Probe Parameters and Coupling Strength

| Probe Parameter | Change in Probe Parameter | Change in Coupling of $TE_{101}$ mode | Change in Coupling of $TM_{110}$ mode | Change in Coupling of $TE_{011}$ mode |
|---|---|---|---|---|
| L1 | ↓ | ↓ | ↑ | ↑ |
| | ↑ | ↑ | ↓ | ↓ |
| θ | ↓ | ↑ | ↑ | ↓ |
| | ↑ | ↓ | ↓ | ↑ |

TABLE 1-continued

Relationship between Probe Parameters and Coupling Strength

| Probe Parameter | Change in Probe Parameter | Change in Coupling of $TE_{101}$ mode | Change in Coupling of $TM_{110}$ mode | Change in Coupling of $TE_{011}$ mode |
|---|---|---|---|---|
| L2 | ↓ | ↑ | ↓ | — |
| | ↑ | ↓ | ↑ | — |
| ΔL | ↓ | ↑ | — | ↑ |
| | ↑ | ↓ | — | ↓ |

The relationships shown in Table 1 may provide a design map to allow a coupling probe 505/515 to be designed for various resonance frequencies and coupling strengths. The desired coupling strength for a particular resonance mode may depend on the bandwidth of the passband (i.e. corresponding resonance frequencies) for that particular resonance mode. If the different passbands have different bandwidths, the coupling strengths may be different.

The coupling strength or coupling coefficients of the different resonance modes (and corresponding resonance frequencies) can be related to the maxima of group delay of the input reflection coefficient $S_{11}$. An example of this relationship is displayed in FIG. 8 below, in which three balanced group delay peaks corresponding to three input couplings are identified at the desired frequencies.

As mentioned above, the coupling probe 505/515 may shift the resonance of the cavity resonator 510. For example, once the coupling probe 505/515 is inserted into the cavity resonator 510, the resonant frequencies of the three resonance modes may drift from their original frequencies. Accordingly, it may be necessary to compensate for this disruption to provide the desired resonant frequencies (i.e. the desired passbands). In some cases, the adjustment members on a cavity resonator may be used to compensate for this drift in resonant frequencies. In some cases, the cavity resonator 510 may be "pre-distorted" to account for the drift in resonant frequency so that the resonant frequencies drift to the desired resonant frequencies as a result of the probe 505/515 being inserted into the cavity.

Figure 6A:
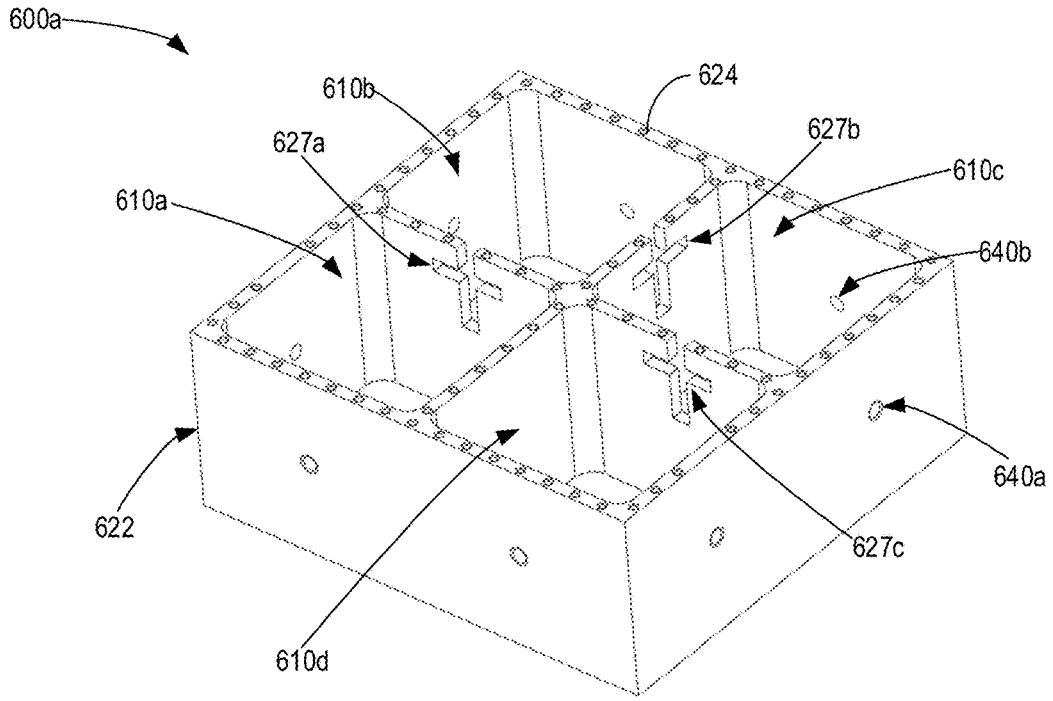
FIG. 6A illustrates a top perspective view of an example filter base in accordance with an example embodiment.
Figure 6B:
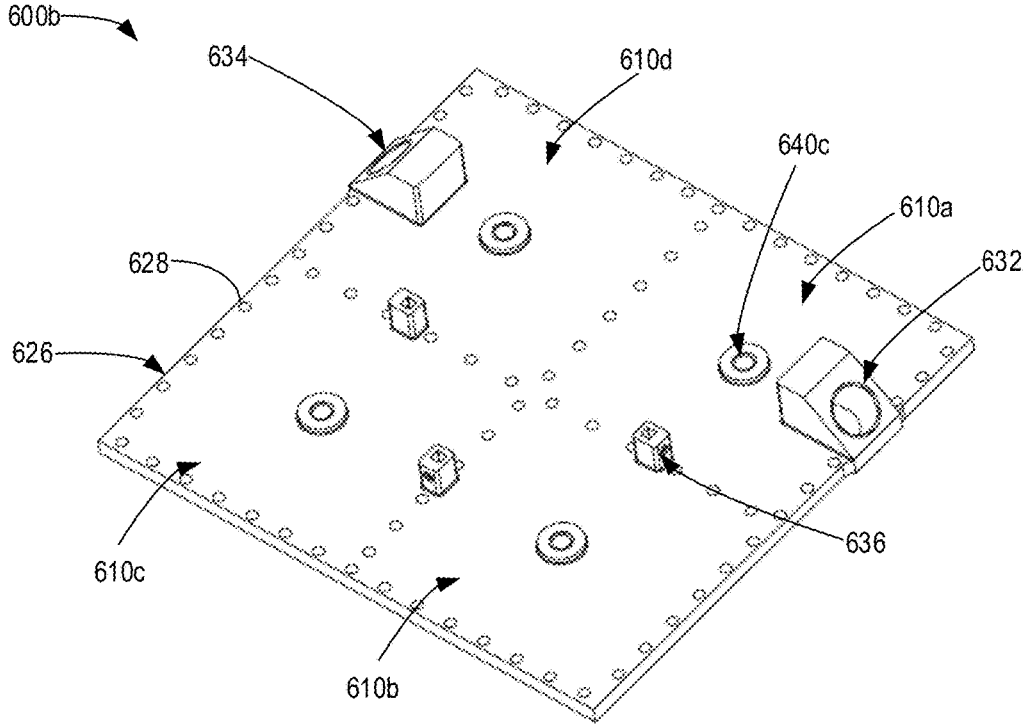
FIG. 6B illustrates a top perspective view of an example filter top in accordance with an example embodiment.

Referring now to FIGS. 6A and 6B, shown therein are illustrations of an example housing for a multi-band bandpass filter such as filter 300. FIG. 6A shows an example housing base 600*a* for the multi-band bandpass filter, while FIG. 6B shows an example housing lid 600*b* for the multi-band bandpass filter. The housing base 600*a* and housing lid 600*b* may be used to provide a folded configuration of a filter such as filter 300 shown in FIG. 3 and discussed above.

The housing base 600*a* include a plurality of cavity resonator sections 610*a*-610*d*. Similarly, the housing lid 600*b* includes a corresponding plurality of cavity resonator sections 610*a*-610*d*. When assembled, the housing base 600*a* and housing lid 600*b* can define the plurality of cavity resonators. The housing base 600*a* may have walls 622 defining 5 faces of the cavity resonators, while the housing lid 600*b* has walls 626 defining the $6^{th}$ face of the cavity resonator.

As explained above, the cavity resonators may each have adjustment members to allow the dimensions of the cavities to be tuned. This may allow the resonant frequencies of the cavity resonators to be adjusted, e.g. to account for any drifting caused by inserting a coupling probe into a cavity. Accordingly, holes 640 for adjustment members may be provided in one or both of the housing base 600*a* and housing lid 600*b*.

The housing base 600*a* may also be shaped to define components of the inter-cavity coupling between cavity resonators. For example, the housing base 600*a* can define window sections 627*a*-627*c* that provide components of the inter-cavity coupling. A conductive probe (not shown) may then be positioned within each window section 627 during assembly of the filter.

In some cases, the housing base 600*a* and housing lid 600*b* can be machined separately and assembled together to define the cavity resonators. This may facilitate positioning conductive probes within the cavity resonator, e.g. by attaching each coupling probe to its corresponding adjustment member 636 at a desired height prior to assembling together the housing base 600*a* and housing lid 600*b*. The probe adjustment members 636 may allow the position of the conductive probe to be adjusted within the cavity resonator after assembly of the filter.

The housing base 600*a* may have attachment locations 624 that may align with corresponding attachment locations 628 on the housing lid 600*b* to allow the housing base 600*a* and housing lid 600*b* to be assembled together. For example, the attachment locations 624 may provide base mating members that correspond to lid mating members provided by the attachment locations 628. This may facilitate aligning the housing base 600*a* and housing lid 600*b* for assembly.

The housing lid 600*b* may also include external interfaces 632 and 634. The external interfaces 632 and 634 may be used to connect a coupling probe (e.g. an input probe or an output probe) to respective input signal paths and output signal paths. For example, the external interfaces 632 and 634 may be provided using bulk-head SMA or TNC connectors attached with a joint and a metal pin. The external interfaces 632 and 634 may correspond to external interface 562 discussed above in relation to FIG. 5.

Referring now to FIG. 7, shown therein is an example multi-band bandpass filter 700. Filter 700 generally corresponds to an implementation of filter 300 using the housing base 600*a* and housing lid 600*b*.

The example filter 700 includes a plurality of cavity resonator sections 710*a*-710*d*. Each of the cavity resonator sections 710 is formed as a rectangular cavity resonator, such as the cavity resonators 310. The filter 700 is provided in a folded configuration. The folded configuration may provide a compact footprint for the filter 700.

The cavity resonator sections 710*a*-710*d* shown in FIG. 7 are defined by the external walls provided by the housing base 722 and housing lid 726. Each cavity resonator 710 may have orthogonally polarized resonance modes, each corresponding to a resonant frequency. The resonant frequencies can be defined by the dimensions of the space enclosed by the cavity (i.e. by the space enclosed by the walls of the housing base 722 and housing lid 726). Each of the cavity resonators may operate in the $TE_{101}$, $TE_{011}$ and $TM_{110}$ modes.

As mentioned above, the housing base 722 and housing lid 726 can be manufactured or machined separately (e.g. as shown in FIGS. 6A and 6B). The housing base 722 and housing lid 726 can then be assembled together, e.g. using connectors at attachment locations 728.

The filter 700 also includes external interfaces 732 and 734. The external interfaces 732 and 734 may be provided using coaxial connectors such as bulk-head SMA or TNC connectors. The external interfaces 732 and 734 can be attached to the housing lid 726, e.g. using a joint and a metal pin. The external interfaces 732 and 734 may correspond to an example of external interface 562 discussed above in relation to FIG. 5.

Each external interface 732 and 734 can be connected to a coupling probe that is positioned within the corresponding cavity resonator (e.g. an input probe or output probe). The coupling probe may be implemented as described herein, for example using the coupling probe shown in FIGS. 5B-5D and described above. Such a coupling probe can be used to excite three polarized modes simultaneously in the first cavity resonator 710*a* and last cavity resonator 710*d* respectively.

The filter 700 can also include an inter-cavity coupling between adjacent cavity resonators 710, such as the example inter-cavity couplings described herein. The inter-cavity couplings may be implemented, for example using the configuration shown in FIG. 5A and described herein above.

The inter-cavity coupling may include one or more window sections. The inter-cavity coupling may also include a conductive probe between the adjacent cavity resonators. The conductive probe may be adjustable or tunable, for example by adjusting the position of the probe. A probe adjustment member 738 can be provided to allow a user to adjust the position of each conductive probe. The probe adjustment member 738 may pass through hole 736 to allow the probe's position within the filter 700 to be adjusted after the filter has been assembled.

As mentioned above, the resonant frequencies of the cavity resonators 710*a*-710*d* may need to be adjusted or tuned. For example, once a coupling probe is positioned within a cavity resonator 710*a* or 710*d*, the resonant frequencies of those resonators may need to be tuned. The resonant frequencies may be tuned by adjusting the dimensions of the cavity resonators. Adjustment members 744*a*, 744*b*, and 744*c* may be provided to adjust the dimensions of the cavity resonators 710.

The adjustment members 744 and/or probe adjustment member 738 may be provided as movable adjustment members. For example, the adjustment members 744 and/or probe adjustment member 738 may be tuning screws. Three tuning screws 744 can be located on the three adjacent planes of each triple-mode resonator to provide independent control of the three resonant frequencies.

The filter 700 is an example of a $4^{th}$ order Chebyshev C-band triple-band filter. The filter 700 was designed using HFSS software available from Ansys. The coupling matrix for all channels was determined to be R1=R4=1.6105, M11=M22=M33=M44=0, M12=M34=1.1950, M23=0.8590. The filter 700 was designed to have center frequencies (i.e. resonant frequencies) of the three passbands at 3.6, 3.8 and 4.0 GHz respectively. The bandwidth of each passband (i.e. resonant frequency) was designed to be 20 MHz. The filter 700 was then constructed using copper for the housing base 722 and housing lid 726. The outside dimensions of the filter 700 were 4.9"×5.2"×2.2". The example multi-band bandpass filter implementation shown in FIG. 7 was tested experimentally and in simulations.

Figure 8:
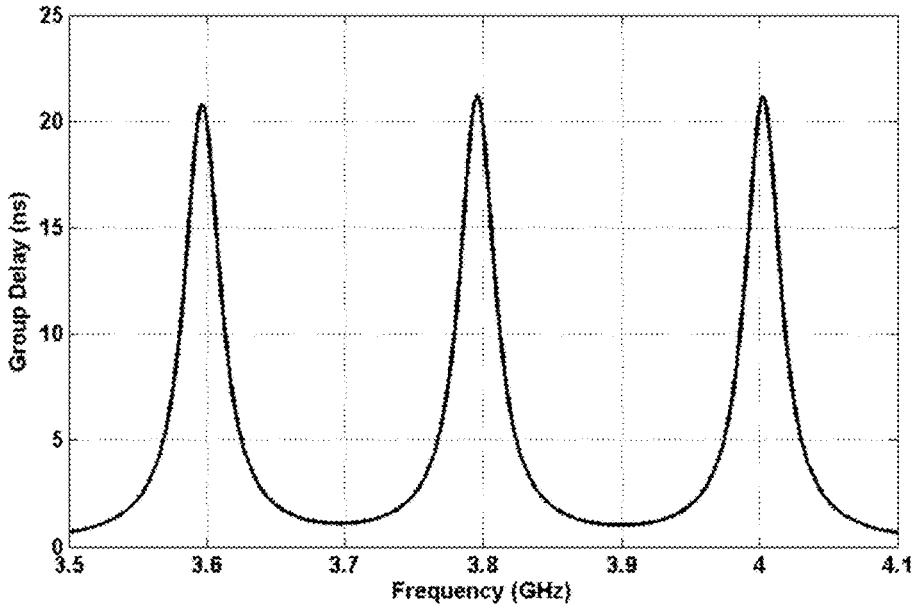
FIG. 8 illustrates a graph plotting group delay response of an example coupling probe in accordance with an example embodiment.

Referring now to FIG. 8, shown therein is a plot showing the simulated group delay response of an example embodiment of a coupling probe, such as the coupling probe shown in FIGS. 5B-5D. FIGS. 8 shows a plot of the group delay for a cavity resonator with a coupling probe (i.e. an input or output probe) generated in a simulation from Ansys HFSS. The coupling probe was designed to couple signals to three pass-bands at 3.6, 3.8 and 4.0 GHz. As shown in the plot in FIG. 8, the group delay peaks corresponding to the three input couplings are found at the desired frequencies.

Figure 9:
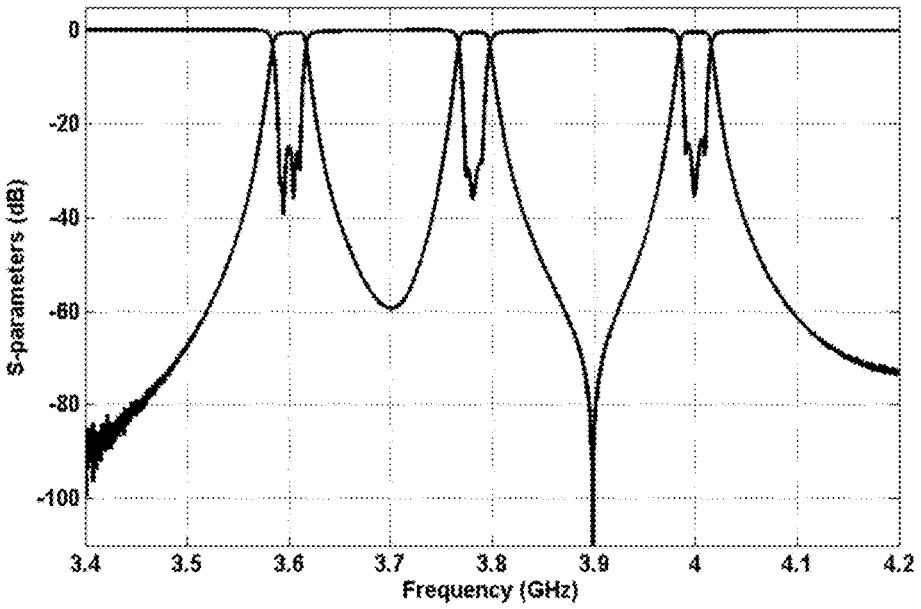
FIG. 9 illustrates a graph plotting an S-parameter of an example multi-band bandpass filter in accordance with an embodiment.

Referring now to FIG. 9, shown therein is a plot showing the measured scattering parameters (S-parameter) of the filter 700. The S-parameter shown in the plot of FIG. 9 was measured using a network analyzer with the filter 700. As shown in the plot of FIG. 9, the return loss was measured to be greater than 23 dB. Rejection between adjacent channels (i.e. between adjacent passbands) was measured to be more than 50 dB.

The plot of FIG. 9 also shows an insertion loss of between 0.38 dB and 0.46 dB. This reflects a loaded Q-factor in the range of 7800-8500. The tuned frequency of the mid-band passband was measured to be slightly lower than the simulated result. This was the result of the conductive probe of the inter-cavity coupling impacting the resonant frequency of the second passband. This impact may be accounted for when defining the dimensions of the cavity resonators in a manner similar to accounting for the impact of the coupling probe, as explained above. The plot of FIG. 9 also shows a transmission zero that was observed between the middle and upper passband. This appears to be the result of a phase reversal at that frequency between the $TE_{011}$ path and $TM_{110}$ path.

Figure 10:
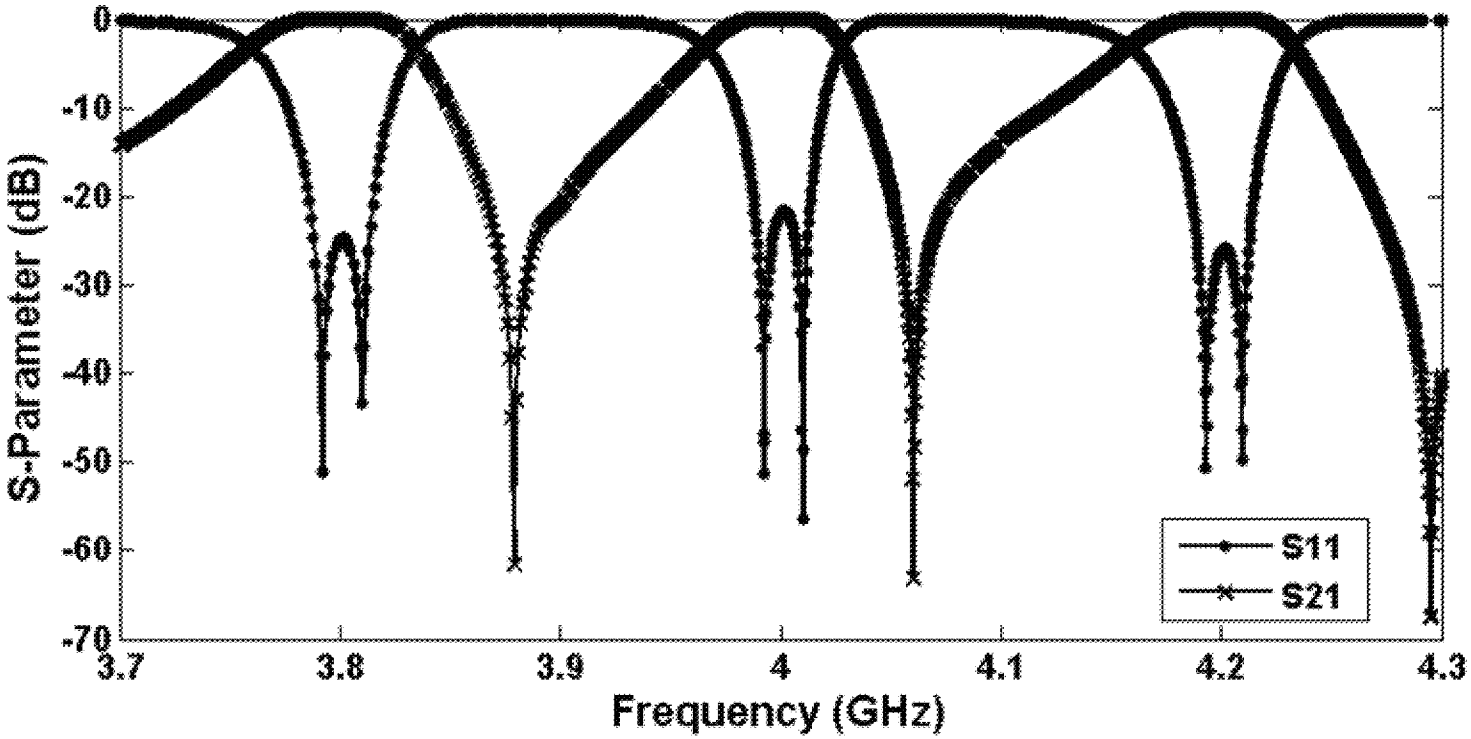
FIG. 10 illustrates a graph plotting an S-parameter of another example multi-band bandpass filter in accordance with an embodiment.

Referring now to FIG. 10, shown therein is a simulated plot of the S-parameter response of a multi-band bandpass filter using elliptical cavity resonators in accordance with an embodiment of the filter 400 shown in FIG. 4. The plot in FIG. 10 was simulated using Ansys HFSS. The plot shown in FIG. 10 illustrates the return loss ($S_{11}$) and insertion loss ($S_{21}$) corresponding to three passbands of the example filter. The simulated results indicate passbands at about 3.8, 4.0 and 4.2 GHz, each with bandwidths of about 40 MHz.

Figure 11:
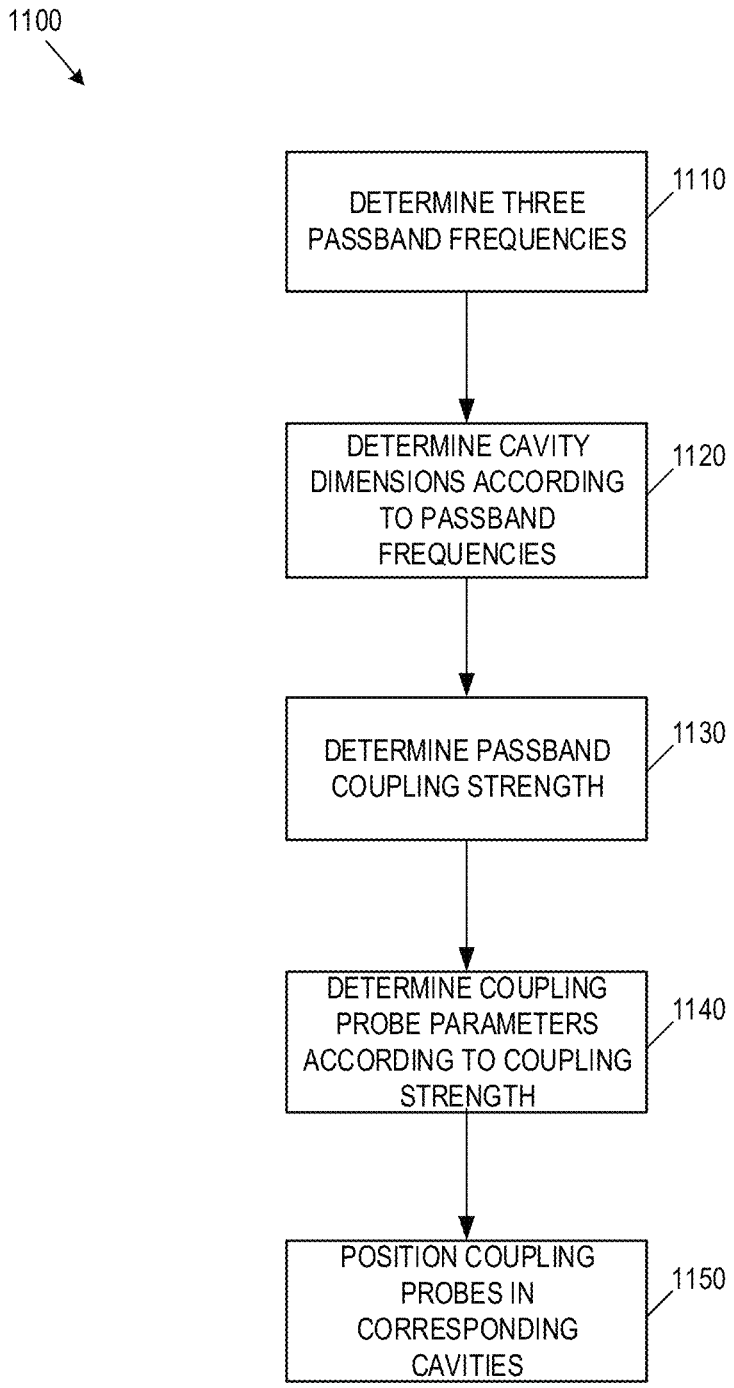
FIG. 11 illustrates a flowchart of an example method for manufacturing a multi-band bandpass filter in accordance with an embodiment.

Referring now to FIG. 11, shown therein is an example process 1100 for manufacturing a multi-band bandpass filter, such as the filters 300, 400, and 700 described herein. Process 1100 may be used to implement a bandpass filter with three passbands using cavity resonators.

As 1110, the three passband frequencies of the filter can be determined. The passband frequencies of the filter can be determined based on desired operational characteristics of the filter. In some cases, the passband frequencies may be limited to a particular frequency range. For example, the passband frequencies may be limited to an operational range of the waveguide structure being used.

At 1120, the dimensions of the cavity resonators can be determined based on the passband frequencies identified at 1110. As explained herein above, the dimensions of the cavity resonator can define the resonant frequencies of the cavity resonator in each of three orthogonal modes. These resonant frequencies can be used to implement the passband frequencies. In some cases, commercial finite element method solvers for electromagnetic structures may be used, such as HFSS.

Depending on the shape of the cavity resonator, the dimensions may be determined in different manners. For example, if an elliptical cavity resonator is being used, the dimensions of the cavity resonator may be determined as described above with reference to filter 400 shown in FIG. 4, such as using equations (2), (3) and (4). Alternatively, if a rectangular cavity resonator is being used, the dimensions of the cavity resonator may be determined as described above with reference to filter 300 shown in FIG. 3, such as using equation (1).

For example, for a rectangular cavity resonator, the width "a", height "b" and length "d" dimensions can be adjusted based on the passband frequencies corresponding to the resonance modes of the cavity resonator. To increase the quality factor of the $TE_{101}$ mode, the "b" dimension may be increased. However, this increase in the "b" dimension may decrease the spurious free window as the cut-off frequency of the $TE_{011}$ mode (i.e. the first spurious mode after increasing "b") may shift closer to the pass band. Thus, the original spurious-modes $TE_{011}$ and $TM_{110}$ may be employed in parallel with the $TE_{101}$ mode to define the three pass-bands frequencies of the cavity resonators. Accordingly, the "b" dimension may be increased with respect to three polarizations in the triple-mode cavities which may result in higher Q for all channels. However, the cut-off frequency of the next resonant mode (e.g. a $TE_{111}$ spurious mode) may also drift toward the upper passband with the increase in the dimension "b".

For the rectangular cavity resonator, the resonant frequency of either $TE_{mnl}$ or $TM_{mnl}$ mode can be uniquely determined by their resonant wave number corresponding to physical dimensions of the cavity "a", "b" and "d". An eigenmode analysis can be performed to calculate the resonant frequencies and unloaded Q as shown in Table 2 below. The first three modes ($TE_{101}$, $TM_{110}$ and $TE_{111}$) can be used to realize the three passbands respectively in the filter. The next mode $TE_{111}$ is nearly 700 MHz higher and may be considered an acceptable spurious-free window.

TABLE 2

Properties of an Example Rectangular Cavity Resonator

| Dimensions (inch) | Mode | Frequency (GHz) | Unloaded Q (Copper) |
|---|---|---|---|
| a = 2.2 | $TE_{101}$ | 3.62 | 16716 |
| b = 1.9 | $TM_{110}$ | 3.83 | 17104 |
| d = 2.4 | $TE_{011}$ | 4.04 | 17566 |
| | $TE_{111}$ | 4.73 | 14690 |

Table 2 illustrates the resonant frequencies and unloaded Q for an example rectangular cavity resonator having three orthogonal resonances modes corresponding to 3 unique resonance frequencies in accordance with an example embodiment.

TABLE 3

Unloaded Q factor of a single-mode WR229 $TE_{101}$ resonator (Copper)

| Frequency (GHz) | Unloaded Q (Copper) |
|---|---|
| 3.62 | 16716 |
| 3.83 | 17104 |
| 4.04 | 17566 |

Next Spurious Mode: 5.625 GHz

Table 3 shows the unloaded Q of a single mode resonator for the first 3 resonance modes. As Tables 2 and 3 illustrate, embodiments described herein using triple-mode resonators may provide higher Q-factors as compared to single mode resonators. Embodiments described herein may have a subsequent mode closer to the pass-band of the highest resonant frequency; however the next mode $TE_{111}$ is nearly 700 MHz higher and may be considered an acceptable spurious-free window.

At 1130, the passband coupling strength or coupling values can be determined for each individual passband. For example, the signal coupling values may be determined using a circuit model of a multi-band filter. A coupling matrix may be determined for the multi-band filter, e.g. extracted from an Eigen-mode simulation with electric & magnetic walls placed along a symmetry plane. In some cases, the coupling strength for the different passbands may be the same. Alternatively, coupling values for different passbands may be different depending on the operational requirements of the filter.

In some cases, the input coupling values and output coupling values may be the same. In some embodiments, the input and output coupling values for a particular filter may differ. For example, in some embodiments a multi-band bandpass filter may be coupled to other components (e.g. a multi-port junction) to provide a more complex signal response. In such embodiments, the filter may not be symmetrical as the input signal path may be connected to the other components (e.g. multi-port junction) while the output signal path is floating.

Figure 13:
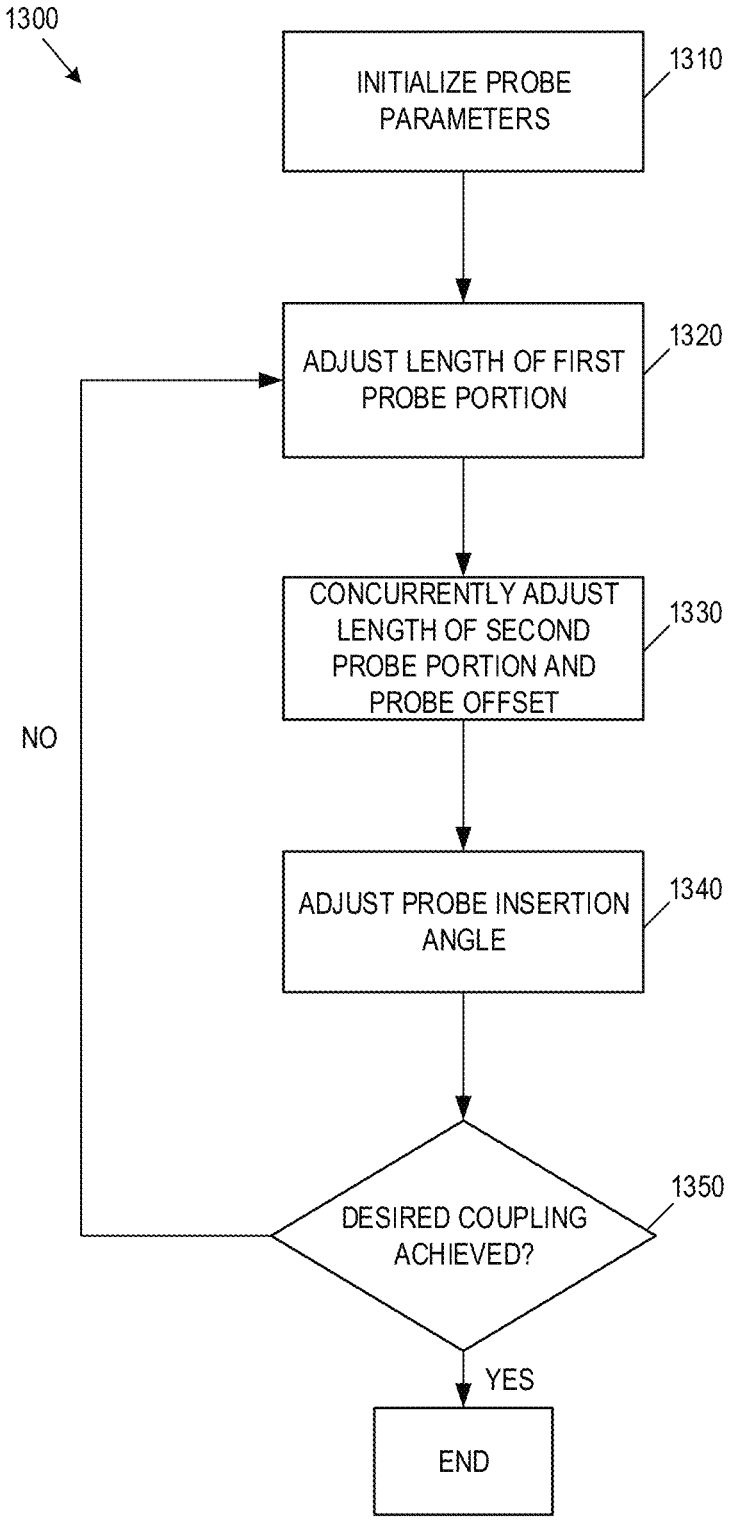
FIG. 13 illustrates a flowchart of an example method for determining coupling probe parameters in accordance with an embodiment.

At 1140, the parameters of the input coupling probe and output coupling probe can be determined based on the passband coupling values determined at 1130. The coupling probe parameters described above with reference to FIGS. 5B-5D may be adjusted using coupling matrix parameters for the different passbands. The parameters may be adjusted as described above with reference to FIGS. 5B-5D, for example using the relationships between parameters and resonance modes shown in Table 1. An example process for determining the coupling probe parameters is shown in FIG. 13, discussed below.

In addition to determining the parameters of the coupling probes, the components of the inter-cavity coupling can be determined based on the coupling values determined at 1130. For example, the number and/or shape of window section(s) in the inter-cavity coupling may be determined based on the coupling values for the corresponding resonance modes (i.e. their respective resonance frequencies/passbands). As well, the position of the window section(s) in the wall between adjacent cavity resonators may be adjusted based on the determined coupling values. The shape and size of a conductive probe may be determined based on the coupling values for the corresponding resonance mode. Similarly, the position of the conductive probe may be adjusted based on the coupling values.

As 1150, the coupling probes can be positioned within the input cavity resonator and output cavity resonator respectively. As mentioned above, this may cause a shift or drift in the resonance frequencies of the input/output cavity resonators. Accordingly, the dimension of the cavity resonators may be adjusted to account for this shift, e.g. using adjustment members.

In some cases, the dimensions of the cavity resonators determined at 1120 may take this shift into account. That is, the dimensions of the coupling probes may be determined prior to determining the dimensions of the cavity resonators. The expected shift in resonant frequencies resulting from placing the probe within the cavity resonator can then be taken into account when determining the dimensions of the cavity resonators at 1120. This may minimize or avoid the necessity for adjusting/tuning the dimensions of the cavity resonators after the coupling probes are positioned in the cavity.

In some cases, the conductive probe of an inter-cavity coupling may also affect the resonant frequency of one or more cavity resonators. The dimensions of the cavity resonators may also be adjusted to account for the impact of the conductive probe, e.g. tuning the dimensions using adjustment members. As with the impact of the coupling probe, the dimensions of the cavity resonators may be determined taking into account the expected impact of the conductive probe to minimize or avoid the need for subsequent tuning.

Figure 12A:
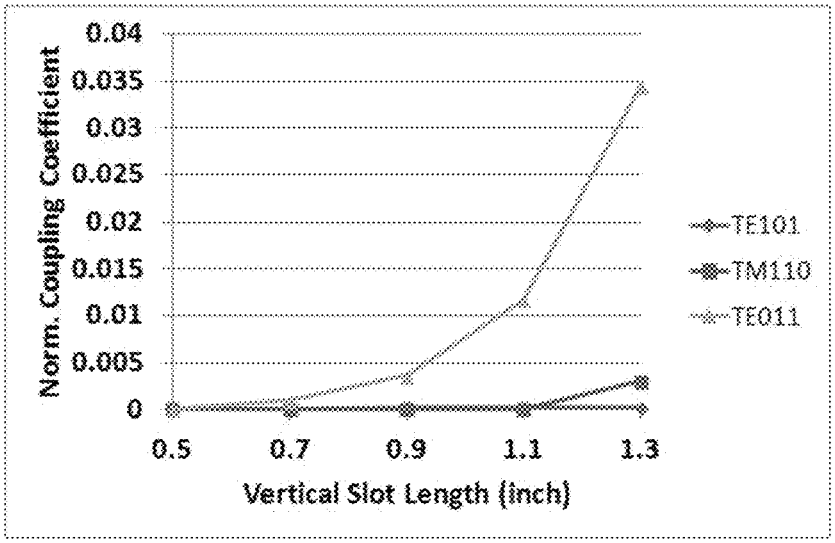
FIG. 12A illustrates a graph plotting coupling coefficients of an example window section in accordance with an embodiment.
Figure 12B:
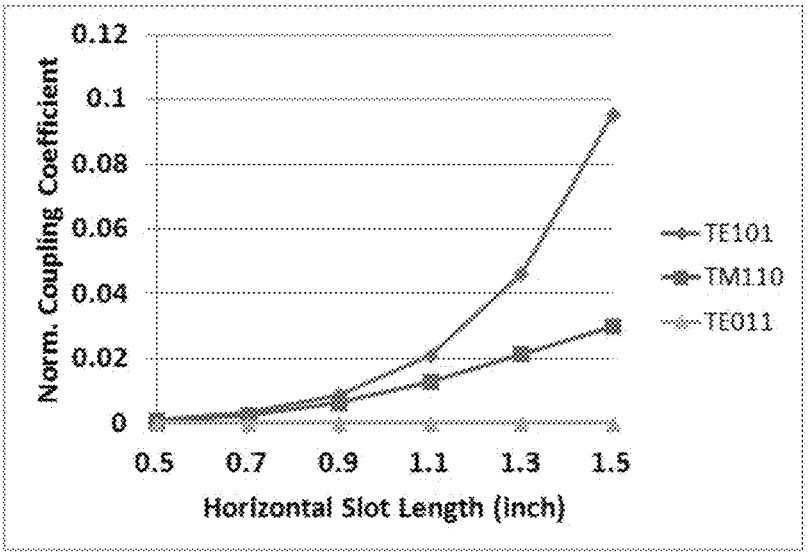
FIG. 12B illustrates a graph plotting coupling coefficients of another example window section in accordance with an embodiment.
Figure 12C:
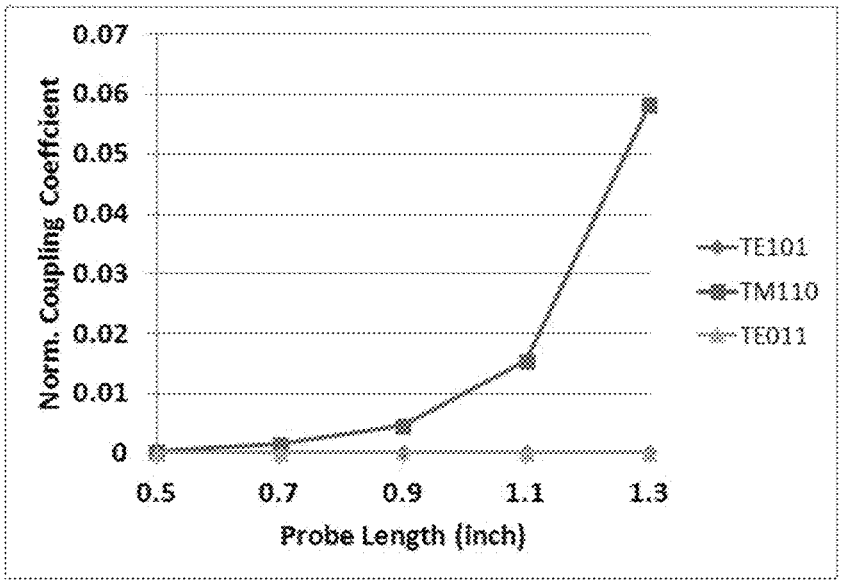
FIG. 12C illustrates a graph plotting coupling coefficients of a conductive probe in accordance with an embodiment.

Referring now to FIGS. 12A-12C, shown therein are plots of the mode-specific coupling corresponding to components of an example inter-cavity coupling between cavity resonators in a multi-band bandpass filter such as that shown in FIG. 5A described above.

The example inter-cavity coupling that corresponds to the plots shown in FIGS. 12A-12C includes 3 primary coupling components, namely a first window section that is substantially horizontal, a second window section that is substantially vertical, and a conductive electrical probe extending substantially perpendicularly between adjacent cavity resonators. As shown in FIGS. 12A-12C, each of the coupling components substantially dominates the inter-cavity coupling of a particular resonance mode.

FIG. 12A illustrates the normalized coupling coefficients of the vertical window section corresponding to the TE101 mode, the TM110 mode, and the TE011 mode as the length of the vertical window section is adjusted. Normalized coupling coefficients may be determined using eigenmode simulations from de-normalized coupling coefficients such as those discussed in relation to equation (5) above, according to:

$$M_1 = k_1 \times \frac{f_0}{BW} \tag{6}$$

where $f_0$ is the center frequency and BW is the bandwidth of a particular resonant frequency.

As FIG. 12A shows, the vertical window section couples signal waveforms predominantly in the $TE_{011}$ mode with some coupling of the $TM_{110}$ mode at higher lengths of the vertical window section.

FIG. 12B illustrates the normalized coupling coefficients of the horizontal window section corresponding to the $TE_{101}$ mode, the $TM_{110}$ mode, and the $TE_{011}$ mode as the length of the horizontal window section is adjusted. As FIG. 12B shows, the horizontal window section couples signal waveforms predominantly in the $TE_{101}$ mode with some coupling of the $TM_{110}$ mode.

FIG. 12C illustrates the normalized coupling coefficients of the conductive probe corresponding to the $TE_{101}$ mode, the $TM_{110}$ mode, and the $TE_{011}$ mode as the length of the probe is adjusted. As FIG. 12C shows, the probe couples signal waveforms predominantly in the $TM_{110}$ mode with minimal coupling of either the $TE_{011}$ or the $TE_{101}$ mode for the lengths shown.

Referring now to FIG. 13, shown therein is a flowchart of an example process 1300 for determining the parameters of a coupling probe in accordance with an embodiment. Process 1300 may be used to determine the parameters of a coupling probe that may be used as an input probe or output probe (such as probes 505/515) in a multi-band bandpass filter.

Process 1300 may be used in a process for manufacturing a multi-band bandpass filter, e.g. at step 1140 of process 1100 described above. In particular, process 1300 is an example process for determining the probe parameters of a probe intended to couple signals in the $TM_{110}$, $TE_{101}$ and $TE_{011}$ modes with defined coupling values.

At 1310, the probe parameters can be initialized. As mentioned, the probe parameters can include length of the first probe portion ($L_2$), length of the second probe portion ($L_1$), a probe insertion angle ($\theta$), and a probe offset ($\Delta L$). The probe parameters may be initialized to baseline or center parameter values, such as $L_2=L_1=\lambda/4$, $\theta=45°$, and $\Delta L=0$. The probe parameters may be initialized to provide initial or baseline probe parameters that can be adjusted during process 1300.

At 1320, the length of the first probe portion, $L_2$, may be adjusted. The length of the first probe portion can be adjusted until the desired coupling values for the $TM_{110}$ are provided.

At 1330, the length of the second probe portion ($L_1$) and the probe offset ($\Delta L$) can be adjusted. The length of the second probe portion ($L_1$) and the probe offset ($\Delta L$) may be adjusted together. In some cases, the length of the second probe portion ($L_1$) and the probe offset ($\Delta L$) may be adjusted substantially concurrently in the sense that they may be adjusted together iteratively. The length of the second probe portion ($L_1$) and the probe offset ($\Delta L$) can be adjusted until the desired overall coupling to the $TE_{101}$ and $TE_{011}$ modes is provided.

At 1340, the probe insertion angle ($\theta$) can be adjusted. The probe insertion angle ($\theta$) can be adjusted until the desired coupling distribution between the $TE_{101}$ and $TE_{011}$ modes (i.e. the distribution of the overall coupling from 1330) is achieved. In other words, the probe insertion angle ($\theta$) can be adjusted until the overall coupling from 1330 is distributed between the $TE_{101}$ and $TE_{011}$ modes to provide the desired coupling values for the $TE_{101}$ and $TE_{011}$ modes.

At 1350, the coupling values to the $TM_{110}$, $TE_{101}$ and $TE_{011}$ modes can be assessed. The coupling values to the $TM_{110}$, $TE_{101}$ and $TE_{011}$ modes can be assessed to determine if the defined coupling values for each of the $TM_{110}$, $TE_{101}$ and $TE_{011}$ modes are met. If the defined coupling values for each of the $TM_{110}$, $TE_{101}$ and $TE_{011}$ modes are met (i.e. they are all satisfied with the probe parameters determined in 1320-1340), then process 1300 may end. If the defined coupling values for one or more of the $TM_{110}$, $TE_{101}$ and $TE_{011}$ modes are not satisfied, then process 1300 may return to step 1320 (or any of steps 1330 and 1340) to adjust the probe parameters to provide the desired coupling values. As process 1300 illustrates, the probe parameters may be adjusted iteratively until the desired coupling is achieved.

Described herein are various embodiments of triple-band bandpass filters and related filter components. Embodiments herein employ cavity resonators with intrinsic cavity resonance modes each with different resonance frequencies. The cavity resonators can have 3 orthogonal resonance modes corresponding to the different resonance frequencies. These different resonance frequencies can define three passbands of the triple-band bandpass filter. In example embodiments described herein, one or more cavity resonators can be used in implementations of the triple-band bandpass filters. Examples of rectangular cavity resonators that may be used with embodiments herein have been described. Similarly, examples of elliptical cavity resonators that may be used with embodiments herein have been described.

Embodiments of filter components, such as coupling probes are also disclosed herein. Embodiments of coupling probes described herein may be used as input and/or output probes for multi-band bandpass filters. Embodiments of coupling probes described herein may allow signals in each of three orthogonal resonance modes (and corresponding resonance frequencies/passband frequencies) to be concurrently coupled into and/or out of a triple-band cavity resonator. Example embodiments of L-shaped coupling probes that may provide concurrent coupling for different resonance frequencies of 3 orthogonal resonances have also been described.

Embodiments of inter-cavity coupling filter components are also disclosed herein. Embodiments of inter-cavity couplings described herein may be used to transmit signals between adjacent resonant filters in a multi-band bandpass filter. Embodiments of the inter-cavity coupling may be operable to concurrently transmit signals in 3 orthogonal resonances modes (and corresponding resonances frequencies) between adjacent filter components. Example embodiments of inter-cavity couplings described herein may include at least one window section and a conductive probe to transmit the resonant signal components between filter components.

The embodiments of triple-band bandpass filters and related filter components described herein may provide various advantages for implementations of bandpass filters. In some cases, embodiments described herein may allow for independent control of resonance frequencies (i.e. passband frequencies). Embodiments described herein may also allow independent control of coupling parameters for the resonance frequencies (i.e. passband frequencies). Embodiments described herein may also provide filters with compact size and reduced mass as compared to some previous filters. Embodiments described herein may also provide improved quality factor from previous filter configurations, as well as stable response with variations in temperature.

Embodiments described herein may be suitable for implementations in various signal transmission systems requiring multi-band bandpass filters. For example, embodiments described herein may find applications in satellite and/or wireless communication systems which require multi-band filters.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A multi-band bandpass filter comprising:

a) at least one cavity resonator, each cavity resonator having three orthogonal resonance modes comprising a first resonance mode, a second resonance mode and a third resonance mode, and each resonance mode having a corresponding unique resonance frequency, the three unique resonance frequencies defining three passbands of the bandpass filter;

b) an input probe coupled to an input cavity resonator of the at least one cavity resonator, the input probe shaped to concurrently couple input signal waveforms into the input cavity resonator in each of the first resonance mode, the second resonance mode and the third resonance mode; and c) an output probe coupled to an output cavity resonator of the at least one cavity resonator, the output probe shaped to be concurrently excitable by signal waveforms in the output cavity resonator in each of the first resonance mode, the second resonance mode and the third resonance mode;

wherein each cavity resonator comprises at least one exterior wall substantially surrounding an enclosed space, the at least one exterior wall defining three perpendicular dimensions of the enclosed space, wherein at least two of the perpendicular dimensions are a different size.

2. The filter of claim 1, wherein a) the at least one cavity resonator comprises a plurality of cavity resonators coupled in a sequence from the input cavity resonator to the output cavity resonator; and b) the filter further comprises an inter-cavity coupling between the cavity resonators in the sequence, the inter-cavity coupling operable to concurrently transmit signal waveforms in each of the resonance modes between adjacent cavity resonators in the sequence.

3. The filter of claim 2, wherein the plurality of cavity resonators comprises at least one intermediate cavity resonator positioned in the sequence between the input cavity resonator and the output cavity resonator.

4. The filter of claim 2, wherein the inter-cavity coupling comprises at least one window section, each window section shaped to transmit signal waveforms in a window-specific mode of the resonance modes between the adjacent cavity resonators.

5. The filter of claim 4, wherein the at least one window section comprises a first window section and a second window section substantially perpendicular to the first window section.

6. The filter of claim 5, wherein the first window section and the second window section intersect.

7. The filter of claim 4, wherein each of the window sections is substantially rectangular.

8. The filter of claim 4, wherein the inter-cavity coupling comprises a conductive probe extending through at least one particular window section of the at least one window section, the conductive probe shaped to transmit signal waveforms in a probe mode of the resonance modes between the adjacent cavity resonators.

9. The filter of claim 1, wherein the input probe comprises a first probe portion connectable to an external interface extending through an exterior of the input cavity resonator along a first axis, the first probe portion extending along the first axis, and a second probe portion positioned within the input cavity resonator and extending from the first probe portion in a direction perpendicular to the first probe portion to define an L-shaped input probe.

10. The filter of claim 1, wherein the output probe comprises a first probe portion connectable to an external interface extending through an exterior of the output cavity resonator along a first axis, the first probe portion extending along the first axis, and a second probe portion positioned within the output cavity resonator and extending from the first probe portion in a direction perpendicular to the first probe portion to define an L-shaped output probe.

11. The filter of claim 10, wherein the input probe comprises a first input probe portion connectable to an external interface extending through an exterior of the input cavity resonator along a first axis, the first probe portion extending along the first axis, and a second input probe portion positioned within the input cavity resonator and extending from the first input probe portion in a direction perpendicular to the first input probe portion to define an input L-shaped input probe.

12. The filter of claim 1, wherein the three orthogonal resonance modes are intrinsic resonance modes of each cavity resonator.

13. The filter of claim 1, wherein each cavity resonator further comprises a plurality of cavity adjustment members, each cavity adjustment member operable to adjust one of the dimensions of the enclosed space.

14. An inter-cavity coupling for a multi-band bandpass filter comprising at least two cavity resonators, each cavity resonator having three orthogonal resonance modes each with a unique resonant frequency, the coupling comprising:

a) at least one window section between two adjacent cavity resonators, each window section shaped to transmit signal waveforms in a window-specific resonance mode between the adjacent cavity resonators, wherein the at least one window section comprises a first window section and a second window section and each window section is shaped to transmit signal waveforms in a window-specific mode of the resonance modes; and b) a conductive probe extending through at least one of the first window section and the second window section, the conductive probe shaped to transmit signal waveforms in a probe resonance mode between the adjacent cavity resonators;

wherein the coupling is operable to concurrently transmit signal waveforms between the adjacent cavity resonators in each of the resonance modes.

15. The coupling of claim 14, wherein the conductive probe extends substantially perpendicularly through the at least one of the first window section and the second window section.

16. The coupling of claim 14, wherein the second window section is substantially perpendicular to the first window section.

17. The coupling of claim 16, wherein each of the first window section and the second window section is substantially rectangular.

18. The coupling of claim 16, wherein the first window section and the second window section intersect.

19. An input or output probe for a multi-band bandpass filter comprising a multi-mode cavity resonator with a plurality of resonance modes including three separate resonance modes, the probe comprising:

a) a first probe portion connectable to an external interface extending through an exterior of the cavity resonator along a first axis, the entire first probe portion extending along the first axis; and b) a second probe portion positionable within the cavity resonator and extending from the first probe portion in a direction perpendicular to the first probe portion, the first probe portion and second probe portion defining an L-shaped probe;

wherein the L-shaped probe is concurrently excitable by signal waveforms in all three resonance modes of the plurality of the resonance modes.

20. The probe of claim 19, wherein a) the first axis extends through the exterior of the cavity resonator at a first surface location;

b) the cavity resonator defines a normal surface axis that is the normal to the exterior of the cavity resonator at the first surface location; and c) the first axis is at an angle to the normal surface axis.

* * * * *